US012473692B2

(12) United States Patent
Lee

(10) Patent No.: US 12,473,692 B2
(45) Date of Patent: Nov. 18, 2025

(54) WALLPAPER COMPOSITION AND WALLPAPER FROM WHICH FLAVOR INGREDIENTS ARE RELEASED BY HEAT

(71) Applicant: KT&G CORPORATION, Daejeon (KR)

(72) Inventor: Changgook Lee, Yuseong-gu (KR)

(73) Assignee: KT&G CORPORATION, Daejeon (KR)

( * ) Notice: Subject to any disclaimer, the term of this patent is extended or adjusted under 35 U.S.C. 154(b) by 0 days.

(21) Appl. No.: 18/253,133

(22) PCT Filed: Nov. 17, 2022

(86) PCT No.: PCT/KR2022/018190
§ 371 (c)(1),
(2) Date: May 16, 2023

(87) PCT Pub. No.: WO2023/090891
PCT Pub. Date: May 25, 2023

(65) Prior Publication Data

US 2024/0368840 A1 Nov. 7, 2024

(30) Foreign Application Priority Data

Nov. 18, 2021 (KR) ..... 10-2021-0159819
May 16, 2022 (KR) ..... 10-2022-0059752

(51) Int. Cl.
*D21H 17/15* (2006.01)
*D21H 17/14* (2006.01)
*D21H 27/20* (2006.01)

(52) U.S. Cl.
CPC ..... *D21H 17/14* (2013.01); *D21H 27/20* (2013.01)

(58) Field of Classification Search
CPC ..... D21H 27/20; D21H 17/12; D21H 17/15; D21H 19/28; D21H 21/14; D21H 19/00; D21H 19/46; D21H 19/60; C09D 5/00; C09D 7/63; C07H 13/06; Y10T 428/3189; C08K 5/01
See application file for complete search history.

(56) References Cited

U.S. PATENT DOCUMENTS 3,499,452 A 3/1970 Kallianos et al.
4,002,179 A 1/1977 Rundberg, Jr. et al.
4,863,987 A * 9/1989 Hoshino ..... C09D 5/00 524/320
4,931,360 A * 6/1990 Hoshino ..... C08K 3/015 426/118
6,557,561 B1 5/2003 Miyauchi et al.
9,156,928 B2 * 10/2015 Nii ..... D21H 19/60
2002/0193269 A1 12/2002 Anderson et al.
2006/0290522 A1 12/2006 Tajima et al.
2024/0341335 A1 * 10/2024 Lee ..... A23L 27/202
2024/0349776 A1 * 10/2024 Lee ..... A24D 1/02
2024/0352673 A1 * 10/2024 Lee ..... C09D 7/63
2024/0365845 A1 * 11/2024 Lee ..... A24B 15/34
2024/0368840 A1 * 11/2024 Lee ..... D21H 17/12
2025/0098733 A1 * 3/2025 Song ..... A24B 15/12

FOREIGN PATENT DOCUMENTS

CN 102311464 A 1/2012
CN 102311465 A 1/2012
CN 109310601 A 2/2019
EP 3 064 069 A1 9/2016
EP 4230684 A1 * 8/2023 ..... C08J 5/045
JP 2015-134931 A 7/2015
JP 7563671 B2 * 10/2024 ..... C07H 13/06
JP 7572018 B2 * 10/2024 ..... C07C 69/96
KR 1994-0005539 A 3/1994
KR 10-2011-0106221 A 9/2011
KR 10-2013-0029062 A 3/2013
RU 2000125554 A 9/2002

OTHER PUBLICATIONS

Communication dated Jan. 8, 2025, issued in Chinese Application No. 202280008233.9.
International Search Report for PCT/KR2022/018190 dated Feb. 27, 2023 [PCT/ISA/210].
J. L. Lynch et al., "Arousals and/or Wake Patterns Associated With Pheromones Administered in the Ambient Environment During Sleep", An applied research project submitted to the National Fire Academy as part of the Executive Fire Officer Program, May 2001, pp. 1-116 (116 pages), XP-002657389.
Extended European Search Report dated Apr. 2, 2024, issued in European Application No. 22879671.0.
Communication dated Jan. 13, 2025 in Russian Application No. 2023114549.
Xiao, et al., "Preparation of micro-encapsulated strawberry fragrance and its application in the aromatic wallpaper", Polish Journal of Chemical Technology, 2017, vol. 19, No. 1, pp. 89-94 (6 pages).

* cited by examiner

*Primary Examiner* — Jose A Fortuna
(74) *Attorney, Agent, or Firm* — Sughrue Mion, PLLC

(57) ABSTRACT

Provided are a flavoring agent that is a compound in which a moiety derived from a flavoring compound is represented by Formula 1 and which is decomposed into a lactone compound and a flavoring compound upon thermal decomposition, a composition including the flavoring agent, and a product including the flavoring agent.

16 Claims, 18 Drawing Sheets

WALLPAPER COMPOSITION AND WALLPAPER FROM WHICH FLAVOR INGREDIENTS ARE RELEASED BY HEAT

TECHNICAL FIELD

The following description relates to a wallpaper composition and a wallpaper, from which flavor ingredients are released by heat.

BACKGROUND ART

A fire detection device (e.g., a fire alarm) that detects a fire in a facility or building and provides a notification is disclosed in various ways and is used in real life. Normally, when a fire occurs, the fire alarm is activated to reduce the damage. However, if there is no fire alarm, or the fire alarm does not work, when a fire breaks out so that interior objects such as furniture or wallpaper are burned at high temperatures due to flames, it is common to recognize that a fire is caused by the spread of combustion products such as smoke, burnt smell, and soot. This means that people in a space far from the point of ignition (e.g., flame) may be delayed in recognizing the fire, resulting in insufficient evacuation time in large buildings and high-rise apartments, so that property and human are damaged.

Accordingly, in the present disclosure, when heat is transmitted by fire, volatile flavor ingredients (e.g., lactone and/or menthol flavors) rapidly diffuse from a part close to the flame of a building on fire to the entire building through a pyrolysis process, and this provides a new fire recognition system or material capable of quickly recognizing a fire by allowing also a person at a distance far from the fire to sniff unique flavor ingredients (e.g., lactone and/or menthol flavors).

DISCLOSURE OF THE INVENTION

Technical Goals

Since existing compounds with a flavoring agent function have low chemical structural stability at room temperature (rt) or a temperature close thereto so that structural transformation or decomposition occurs to result in volatilization of flavor ingredients, there is a problem that the flavor expression function in the occurrence of a fire is the recognizable level or less, or such a function is not expressed. In order to solve this problem, an objective to be achieved by the present disclosure is to provide a wallpaper composition which includes a novel compound that has excellent chemical structural stability at room temperature or a temperature close thereto and releases volatile and/or flavor ingredients by thermal decomposition when heated, and which is capable of promptly recognizing a fire by such volatile and/or flavor ingredients.

Another objective to be achieved by the present disclosure to provide a wallpaper which is manufactured of the wallpaper composition according to the present disclosure, from which volatile and/or flavor ingredients are released by thermal decomposition when heated, and thus a fire may be quickly recognized.

The present disclosure provides a wallpaper composition according to the present disclosure or a paint composition including a novel compound represented by Formula 1 according to the present disclosure.

However, the problem to be solved by the present disclosure is not limited to those mentioned above, and other problems not mentioned will be clearly understood by those skilled in the art from the description below.

Technical Solutions

According to one embodiment of the present disclosure, the present disclosure relates to a wallpaper composition including a base material of which compound is represented by Formula 1 below.

[Formula 1]

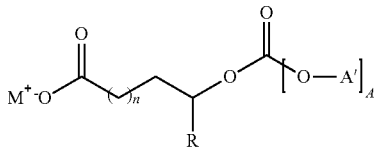

(In Formula 1, n is an integer of 1 or 2,

M is selected from alkali metals and transition metals,

R is a straight-chain or branched-chain alkyl group having 1 to 30 carbon atoms, and moiety A is a moiety derived from a flavoring compound having at least one of an aromatic ring, an aliphatic ring, and an aliphatic chain which have a hydroxyl group, in which the hydroxyl group participates in a carbonate linking group

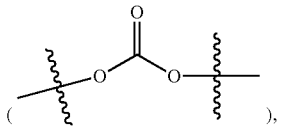

and A' corresponds to a flavoring compound except for the hydroxyl group.)

According to one embodiment of the present disclosure, the flavoring compound may be selected from a cyclic monoterpene-based compound having a hydroxyl group, a monoterpene-based acyclic compound having a hydroxyl group, a $C_6$-$C_{10}$ aromatic compound having a hydroxyl group, and a $C_5$-$C_6$ non-aromatic ring having a hydroxyl group.

According to one embodiment of the present disclosure, the transition metal may be selected from Zr, Mg, Ca, Co, Rh, Ir, Nb, Pd, Pt, Fe, Ru, Os, Cr, Mo, W, Mn, Tc, Re, Cu, Ag, and Au, and the alkali metal may be selected from Li, Na, K, Rb, and Cs.

According to one embodiment of the present disclosure, the present disclosure relates to a wallpaper or paint manufactured from the composition according to the present disclosure.

Effects

According to one embodiment of the present disclosure, the wallpaper composition according to the present disclosure can be molded into wallpaper itself or easily applied to wallpaper base paper, building structures, interior products, etc., and can be thermally decomposed to express highly volatile lactones and/or flavor ingredients when it is directly heated or affected by the temperature of an ignition point. Since these thermal decomposition components spread throughout the building, even humans who are close to or far from the ignition point can quickly recognize the fire.

BEST MODE FOR CARRYING OUT THE INVENTION

Figure 1:
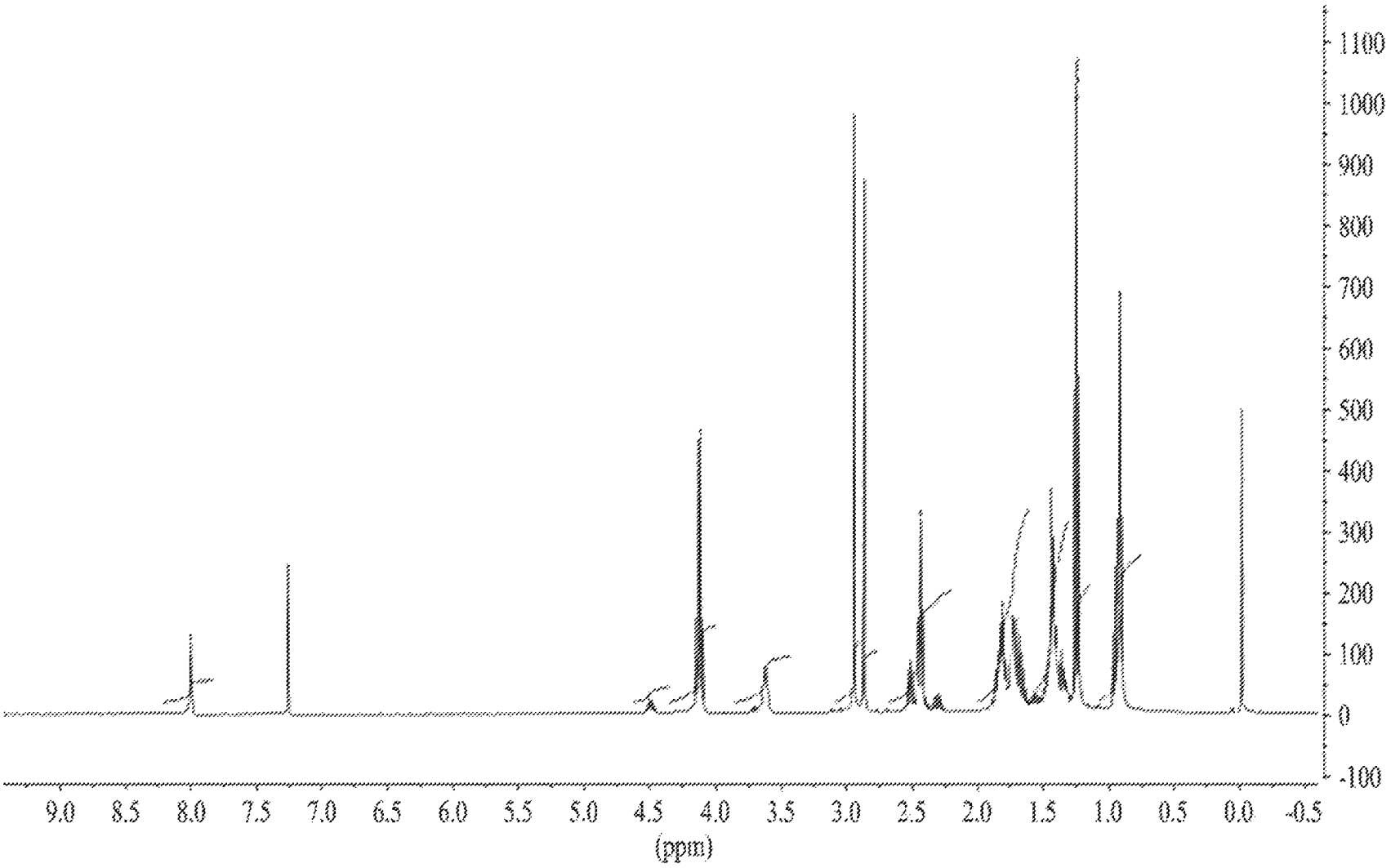
FIG. 1 is a diagram illustrating the results of NMR analysis of ethyl 4-hydroxyheptanoate (2a) prepared in an example according to one embodiment of the present disclosure.
Figure 2:
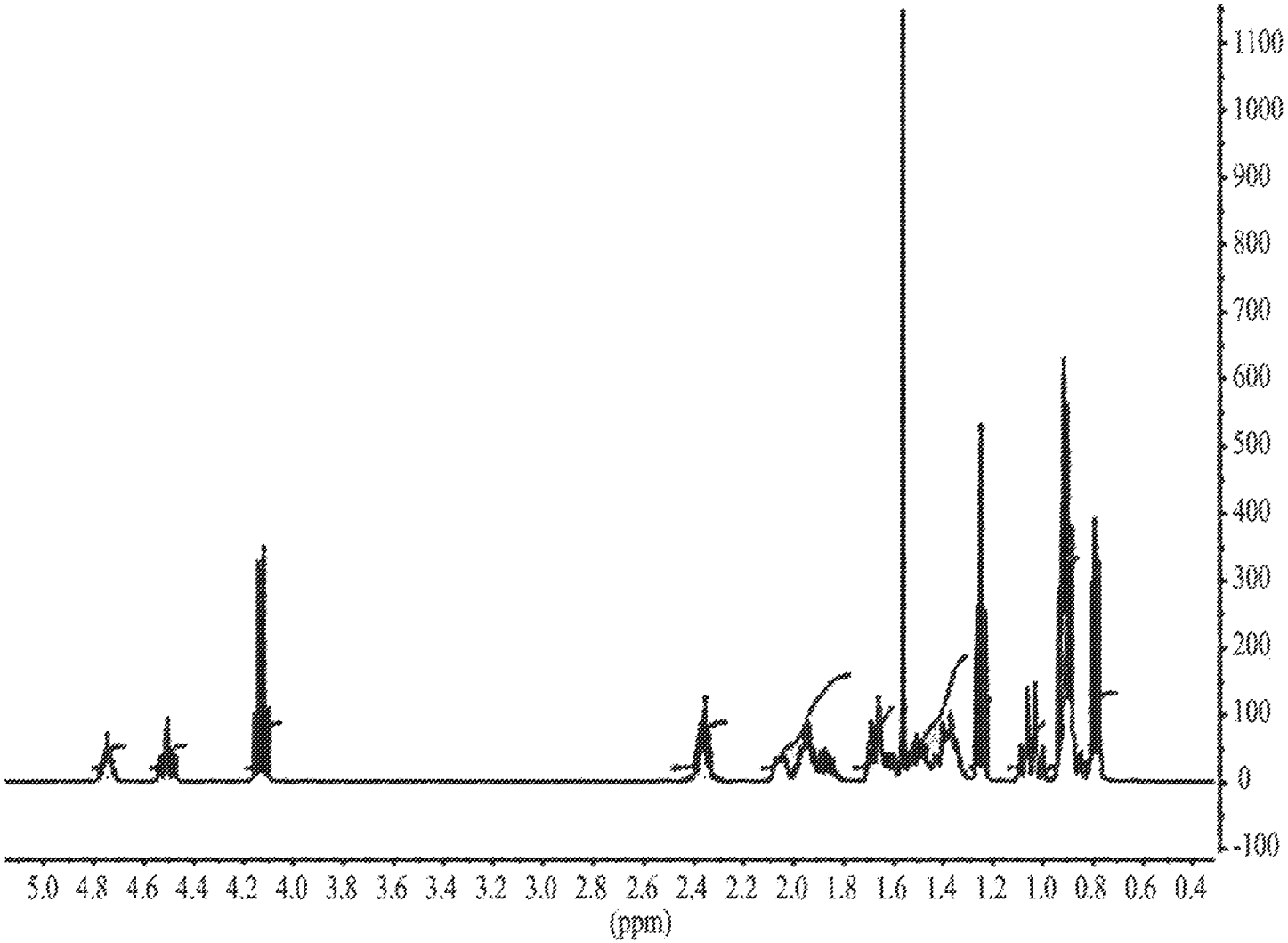
FIG. 2 is a diagram illustrating the results of NMR analysis of ethyl 4-(mentylcarbonyloxy) heptanoate (3a) prepared in an example according to one embodiment of the present disclosure.
Figure 3:
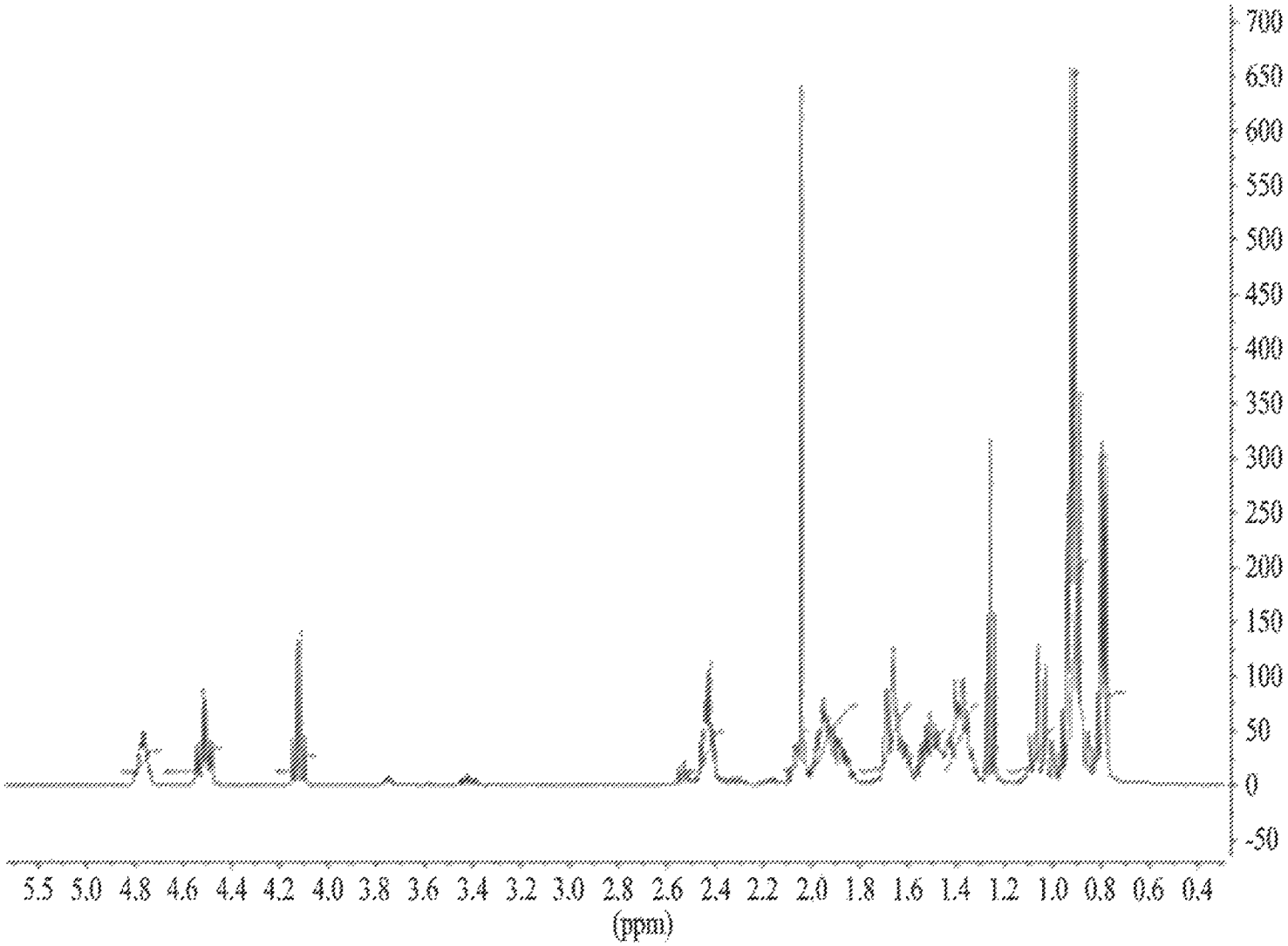
FIG. 3 is a diagram illustrating the results of NMR analysis of 4-(mentylcarbonyloxy) heptanoic acid (4a) prepared in an example according to one embodiment of the present disclosure.
Figure 4:
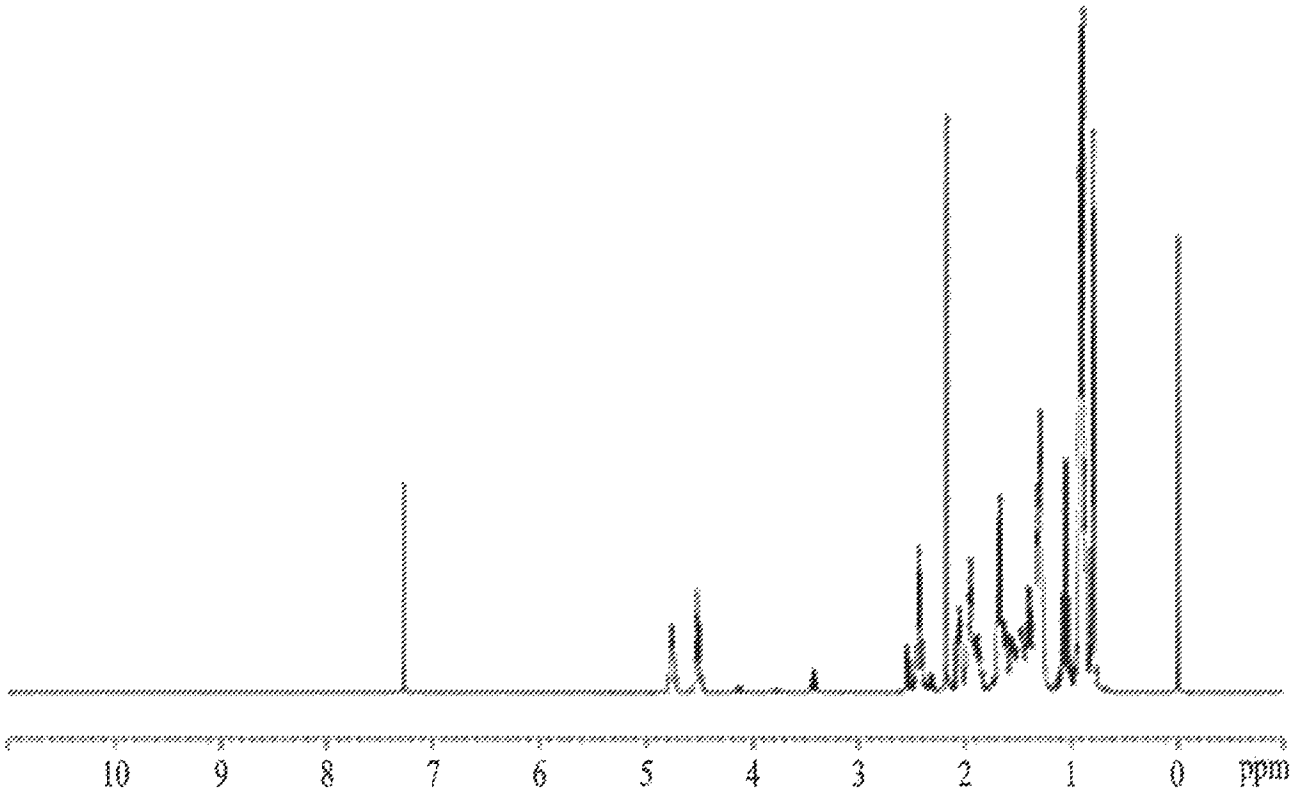
FIG. 4 is a diagram illustrating the results of NMR analysis of 4-(mentylcarbonyloxy) nonanoic acid (4b) prepared in an example according to one embodiment of the present disclosure.
Figure 5:
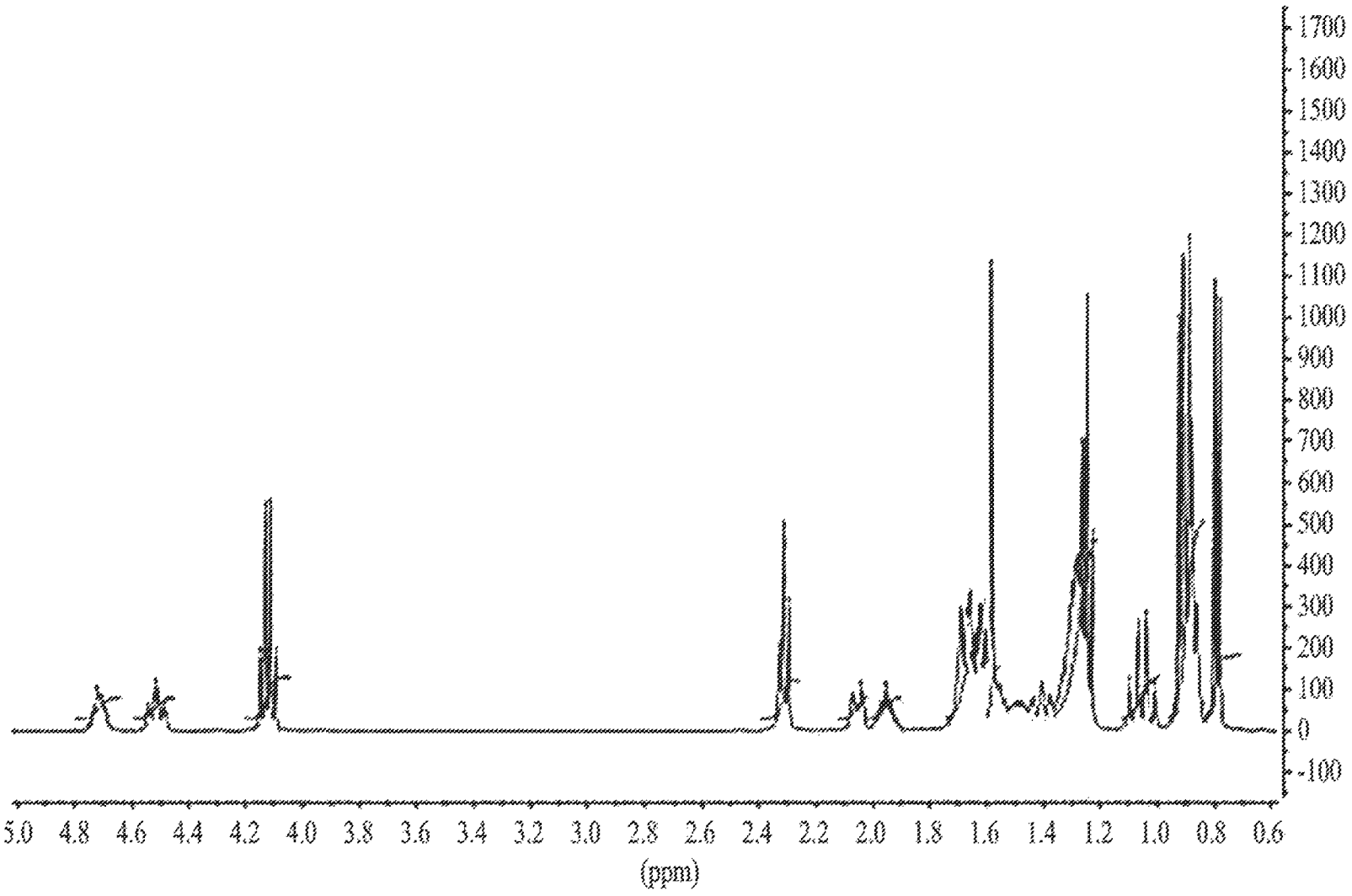
FIG. 5 is a diagram illustrating the results of NMR analysis of 5-(mentylcarbonyloxy) decanoate (3c) prepared in an example according to one embodiment of the present disclosure.
Figure 6:
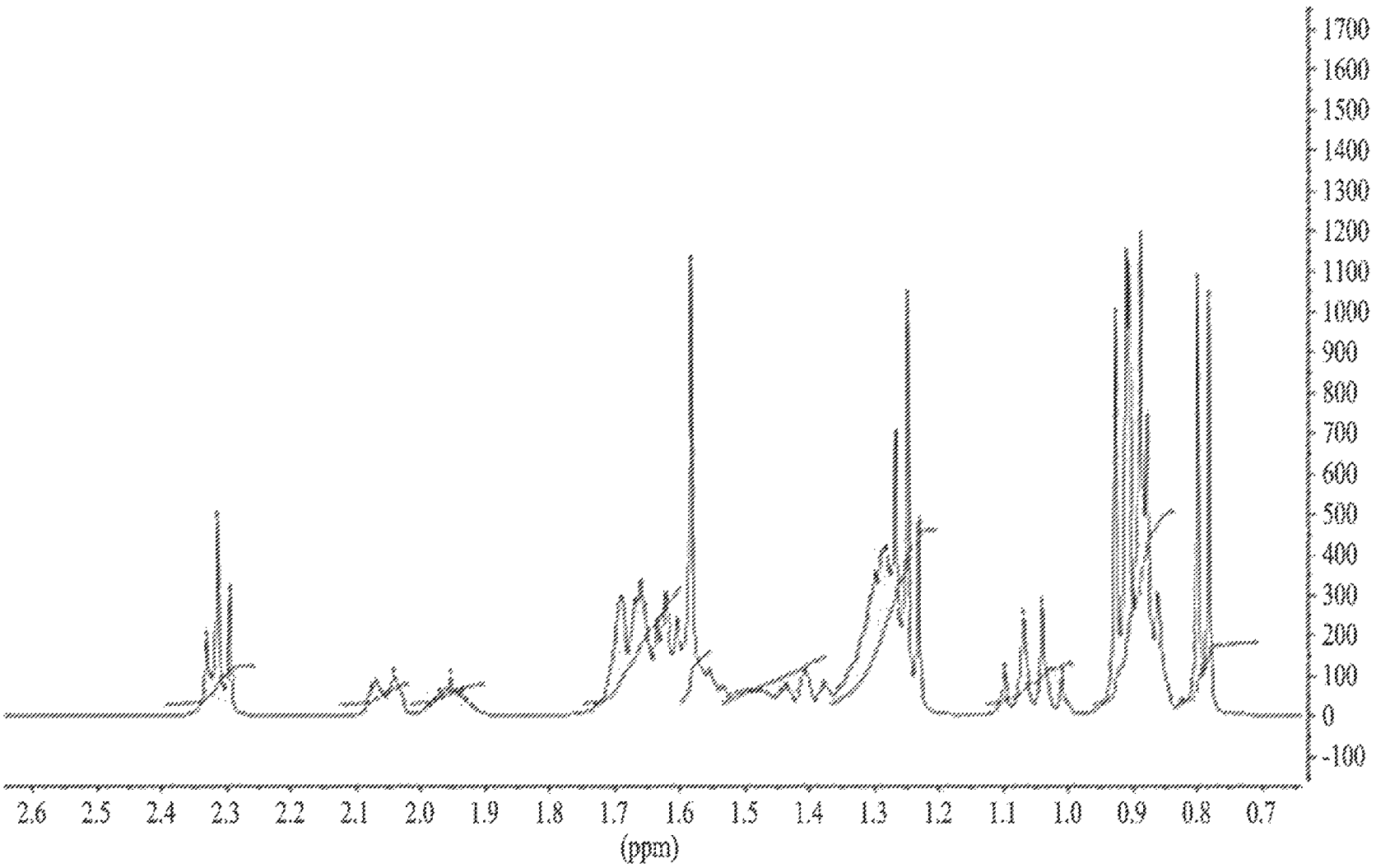
FIG. 6 is a diagram illustrating the results of NMR analysis of 5-(mentylcarbonyloxy) decanoate (3c) prepared in an example according to one embodiment of the present disclosure.
Figure 7:
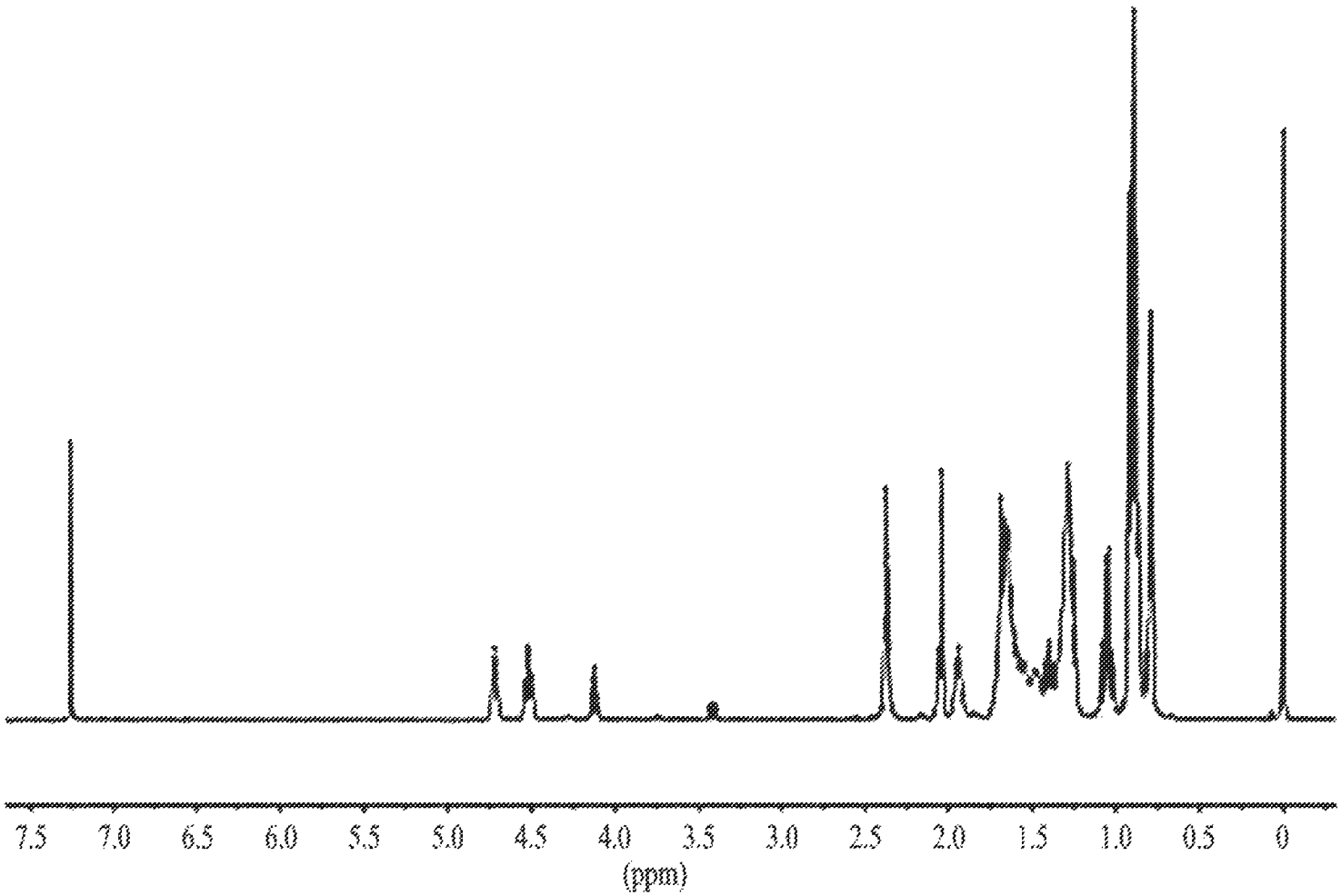
FIG. 7 is a diagram illustrating the results of NMR analysis of 5-(mentylcarbonyloxy) decanoic acid (4c) prepared in an example according to one embodiment of the present disclosure.
Figure 8:
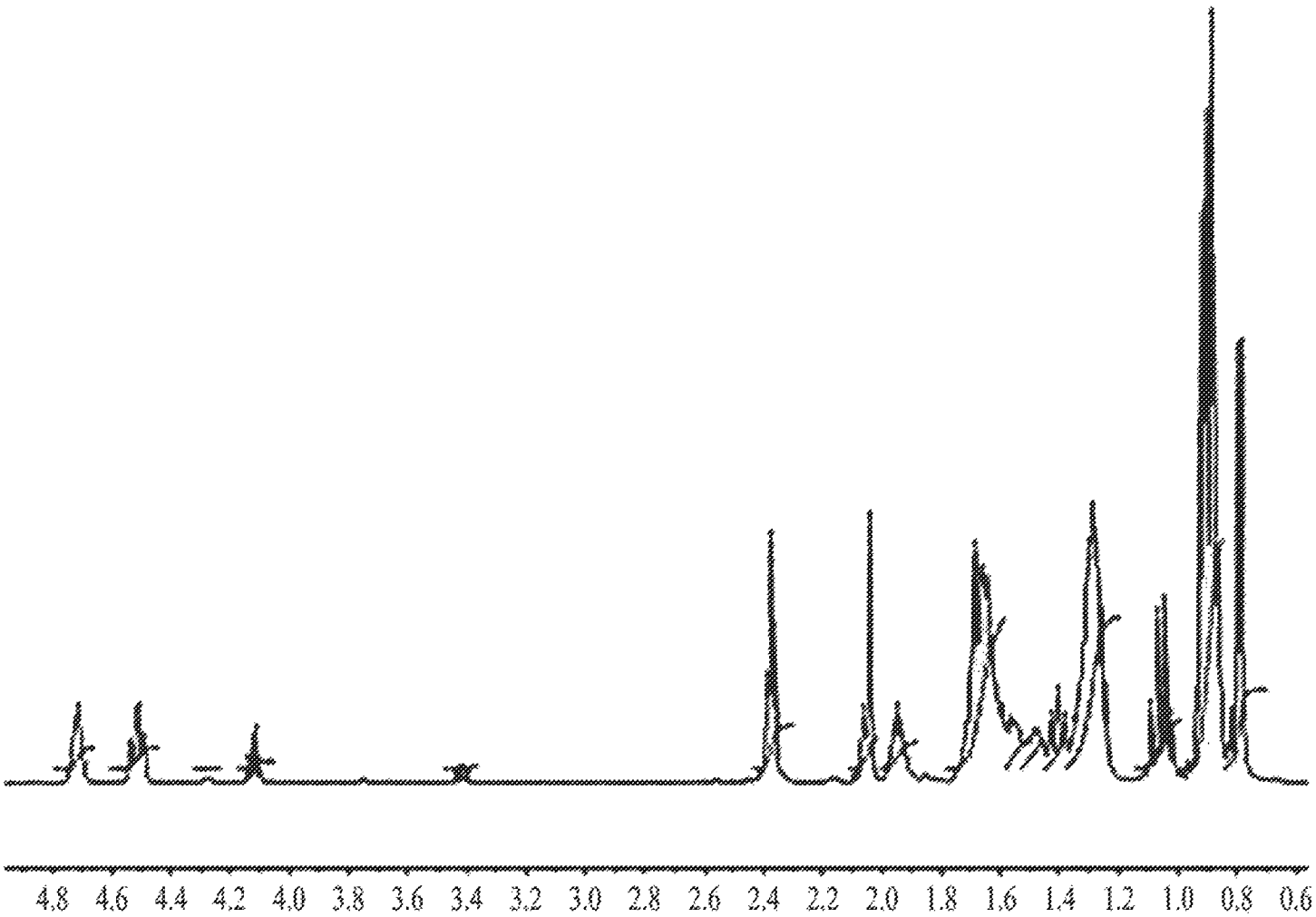
FIG. 8 is a diagram illustrating the results of NMR analysis of 5-(mentylcarbonyloxy) decanoic acid (4c) prepared in an example according to one embodiment of the present disclosure.
Figure 9:
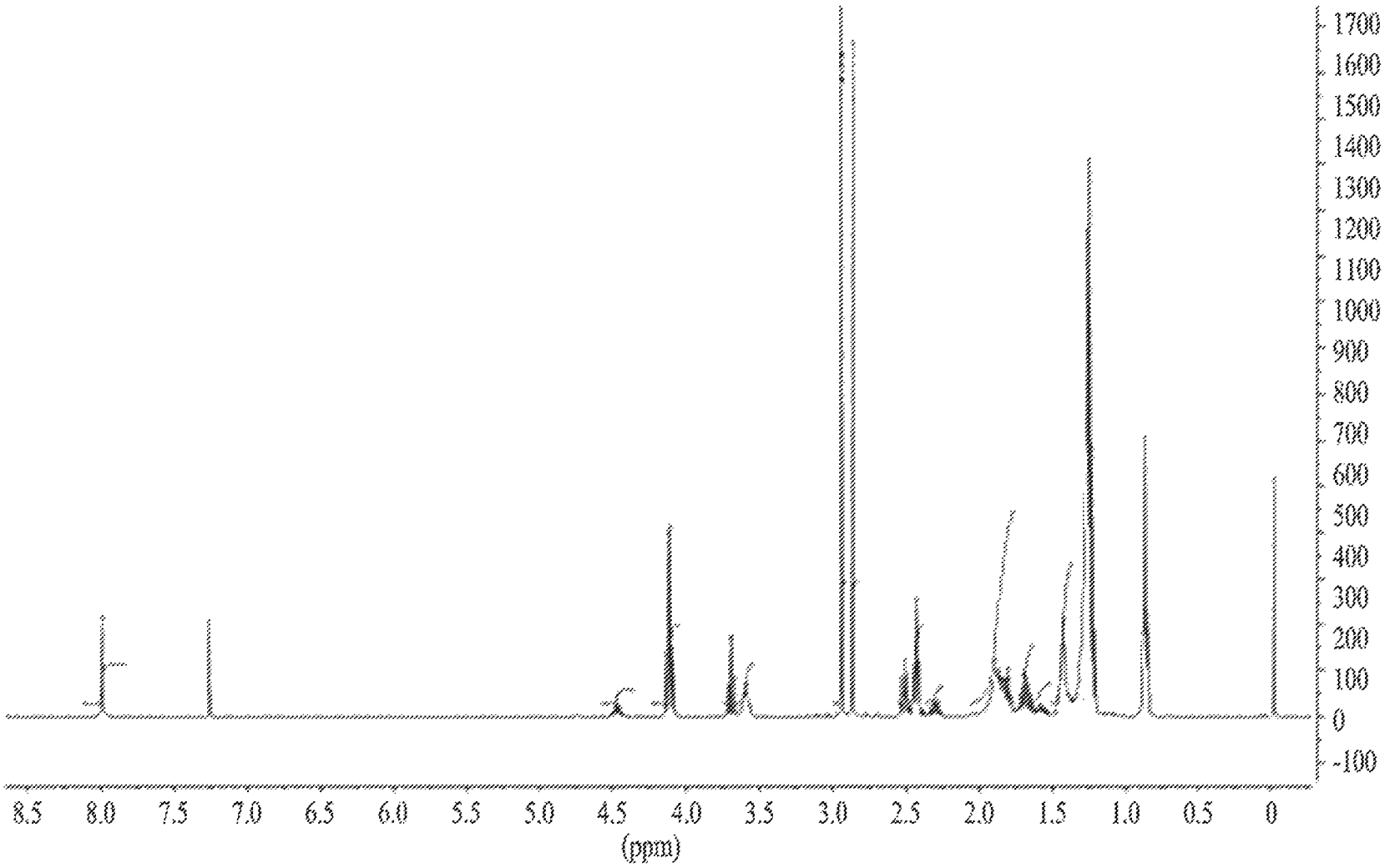
FIG. 9 is a diagram illustrating the results of NMR analysis of ethyl 4-hydroxyundecanoate (2d) prepared in an example according to one embodiment of the present disclosure.
Figure 10:
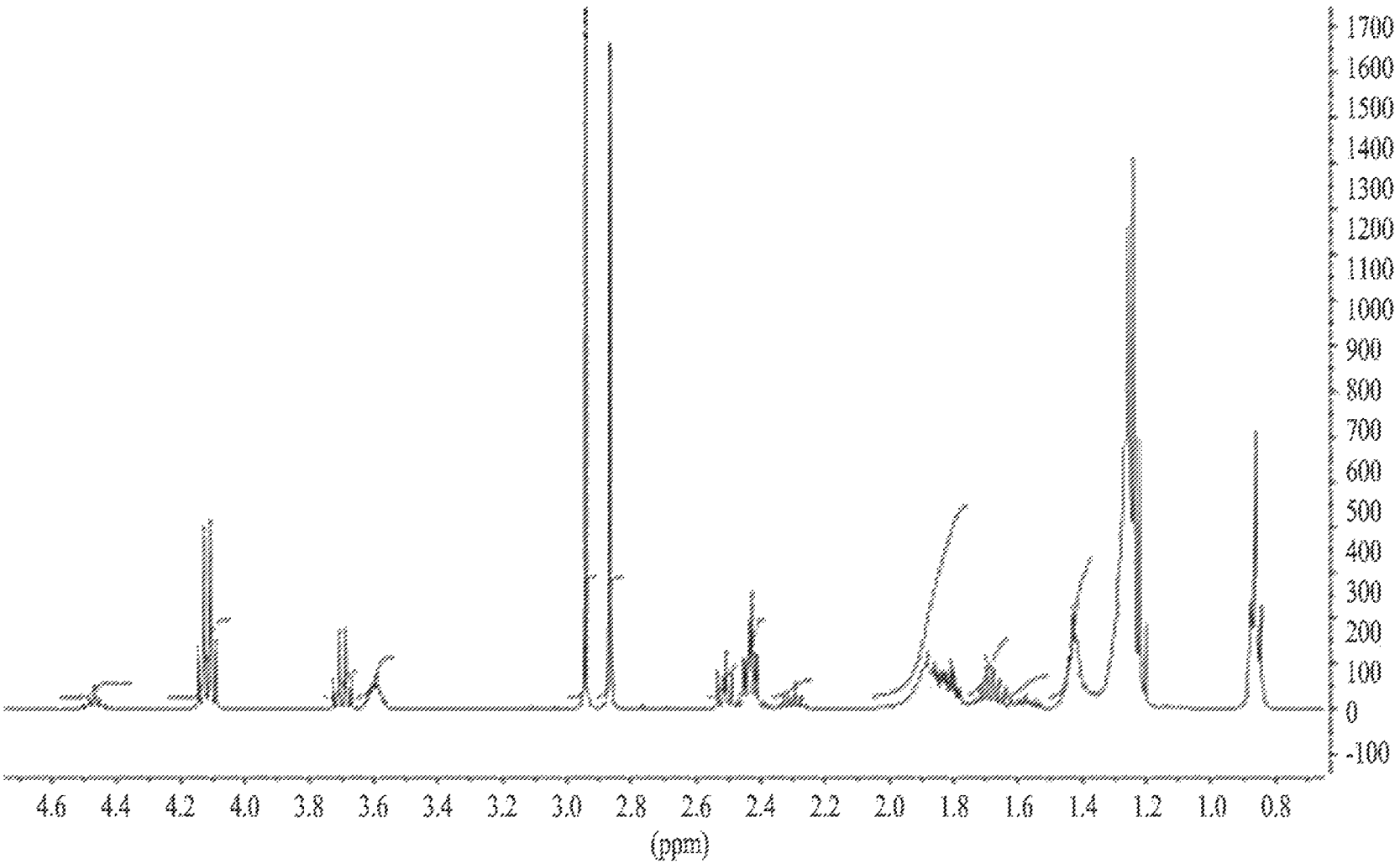
FIG. 10 is a diagram illustrating the results of NMR analysis of ethyl 4-hydroxyundecanoate (2d) prepared in an example according to one embodiment of the present disclosure.
Figure 11:
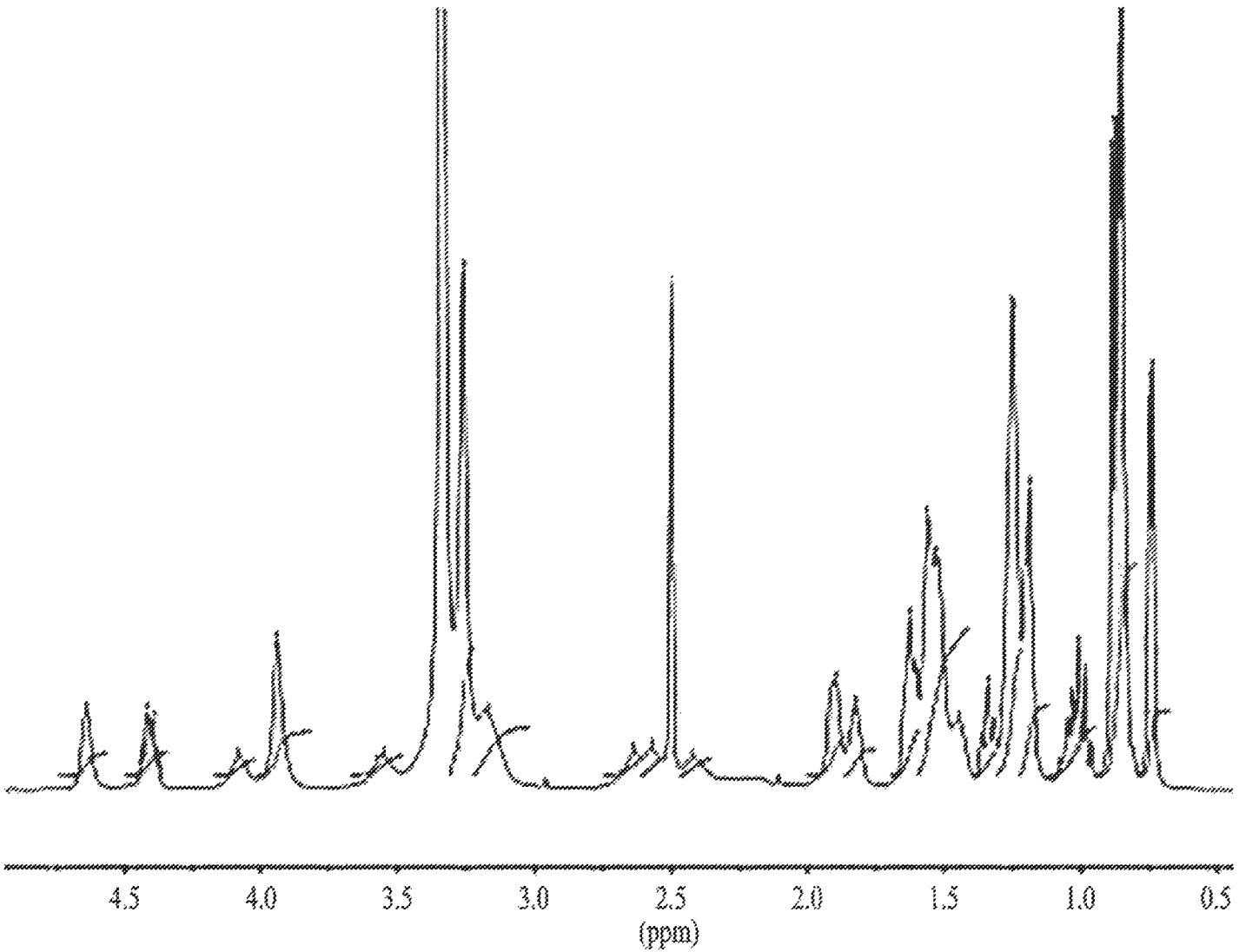
FIG. 11 is a diagram illustrating the results of NMR analysis of ethyl 4-(mentylcarbonyloxy) undecanoate (3d) prepared in an example according to one embodiment of the present disclosure.
Figure 12:
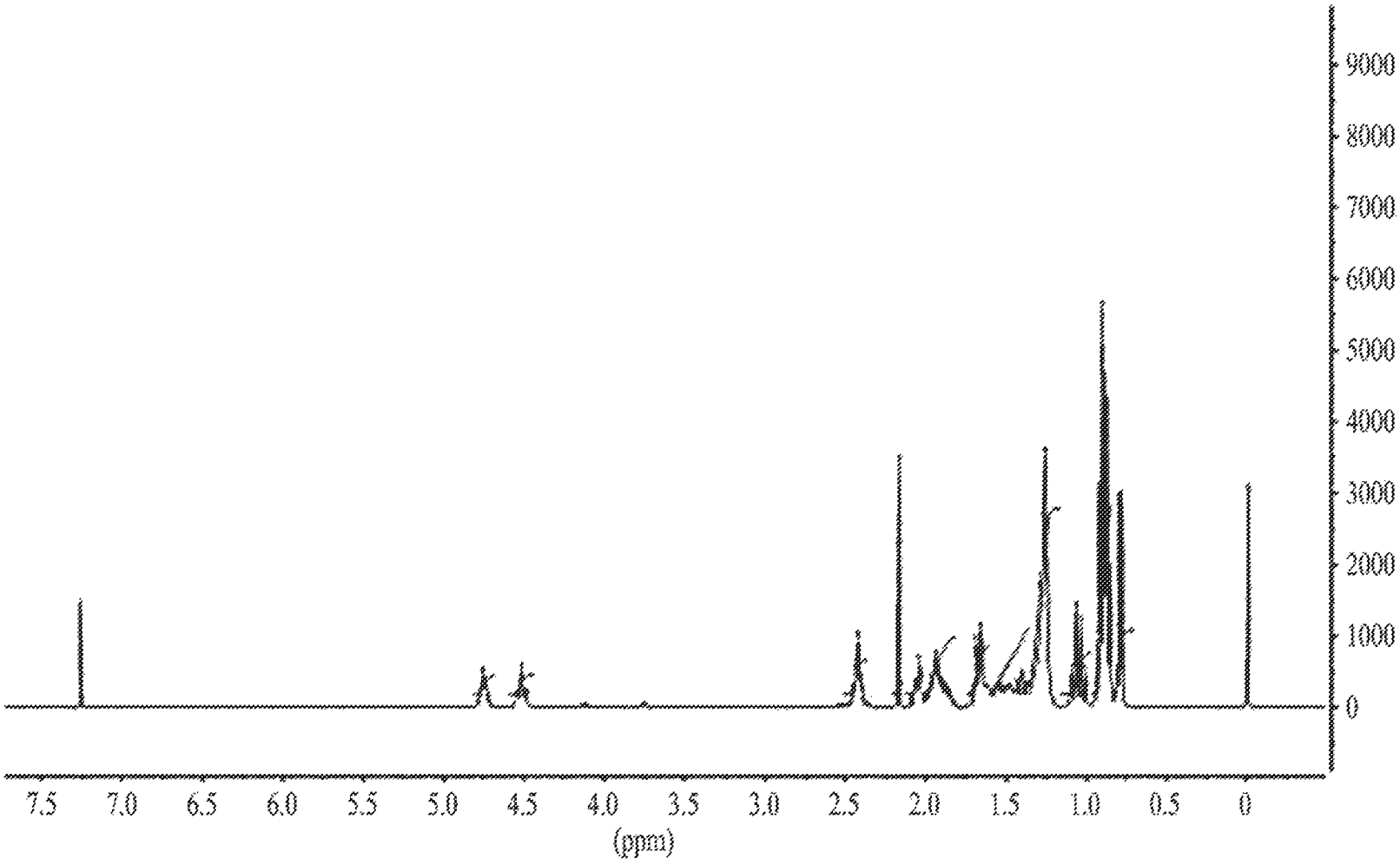
FIG. 12 is a diagram illustrating the results of NMR analysis of 4-(mentylcarbonyloxy) undecanoic acid (4d) prepared in an example according to one embodiment of the present disclosure.
Figure 13:
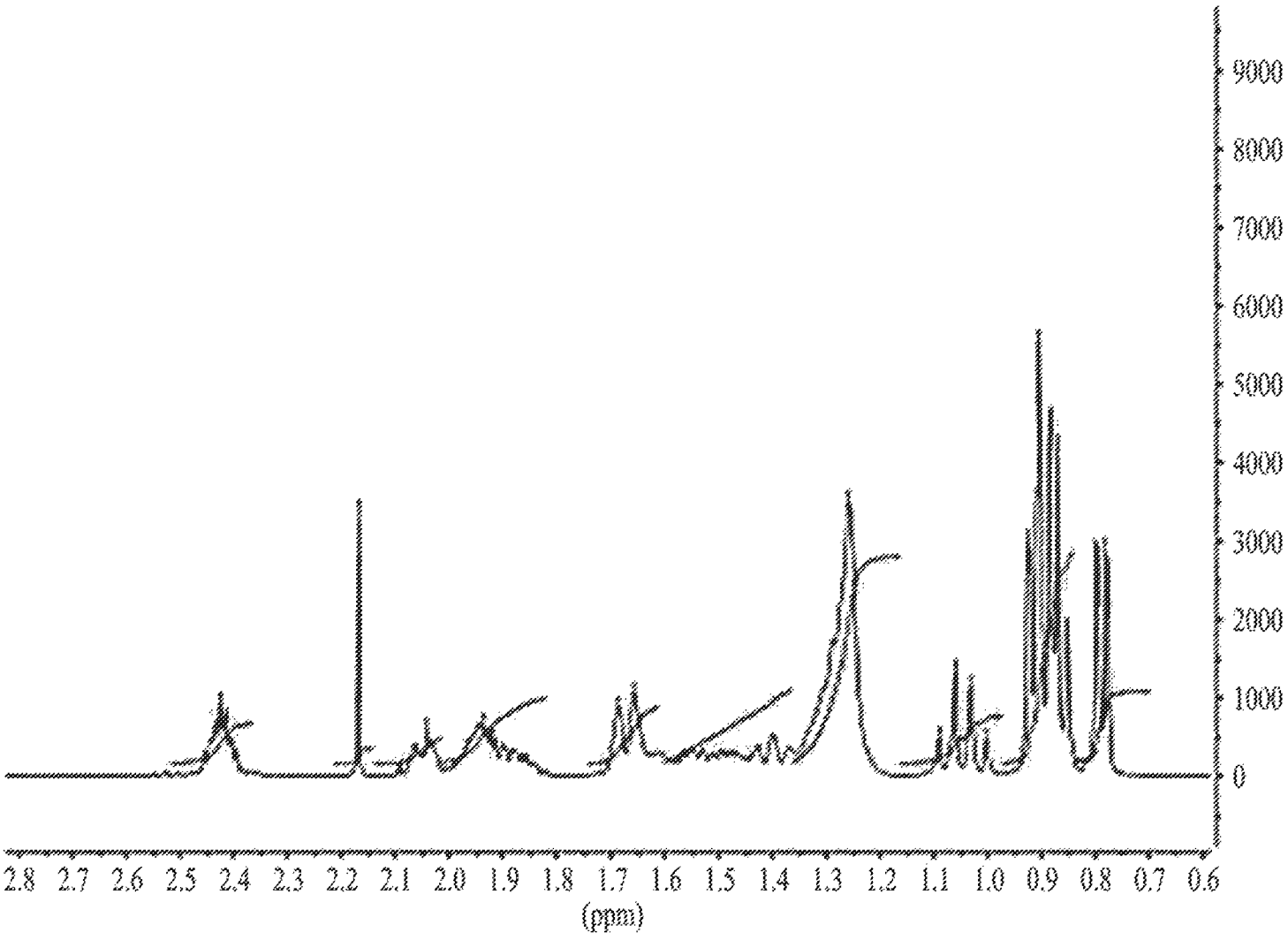
FIG. 13 is a diagram illustrating the results of NMR analysis of 4-(mentylcarbonyloxy) undecanoic acid (4d) prepared in an example according to one embodiment of the present disclosure.
Figure 14:
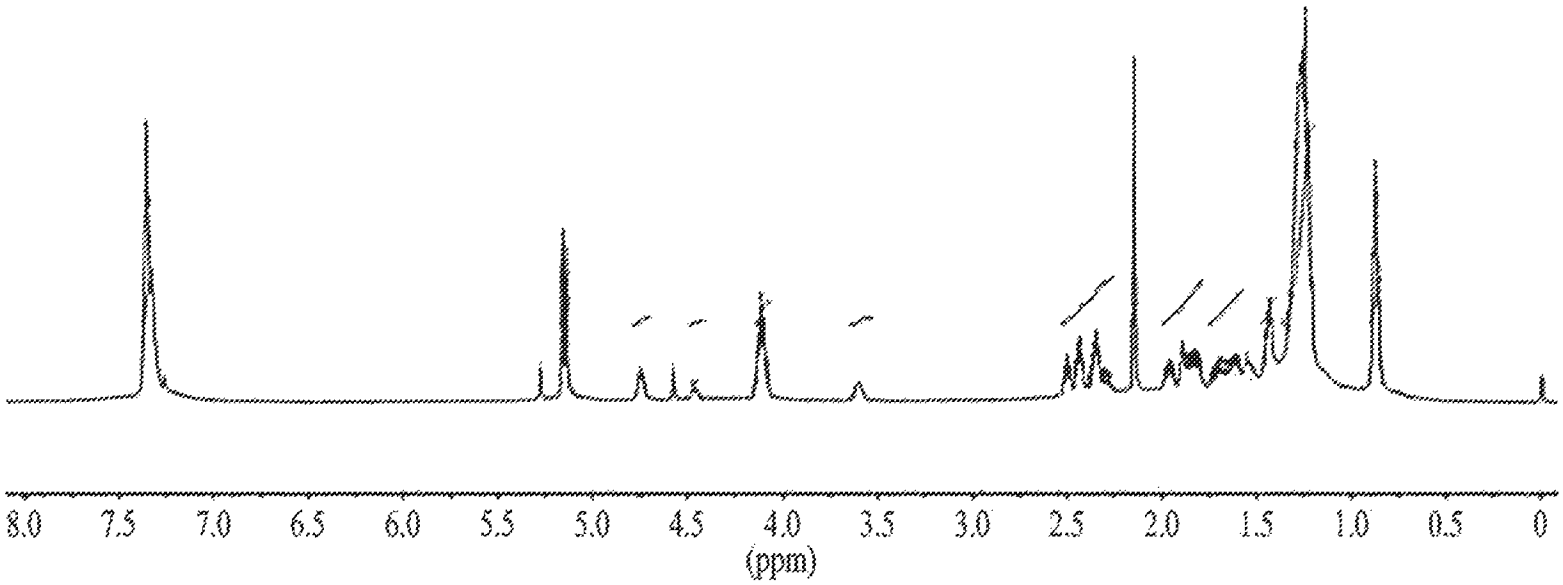
FIG. 14 is a diagram illustrating the results of NMR analysis of ethyl 4-(benzyloxycarbonyloxy) undecanoate (3e) prepared in an example according to one embodiment of the present disclosure.

Hereinafter, embodiments of the present disclosure will be described in detail with reference to the accompanying drawings. In describing the present disclosure, if it is determined that a detailed description of a related well-known function or configuration may unnecessarily obscure the gist of the present disclosure, the detailed description thereof will be omitted. Also, terms used in the present specification, as terms which are used so as to appropriately describe a preferred embodiment of the present disclosure, may be changed depending on the user's or operator's intention or the practices of the field to which the present disclosure pertains. Therefore, the definitions of the terms should be made based on the contents throughout the present specification. The same reference numerals disclosed in each drawing represent the same members.

Throughout the specification, when a member is said to be located "on" other member, this includes not only a case in which a member is in contact with other member but also a case in which another member exists between the two members.

Throughout the specification, when a part "includes" a certain component, it means that other components may be further included, rather than excluding other components.

Hereinafter, a composition including a compound according to the present disclosure and its utilization will be described in detail with reference to embodiments and drawings. However, the present disclosure is not limited to these embodiments and drawings.

The present disclosure relates to a composition including a compound according to the present disclosure. According to one embodiment of the present disclosure, the composition may include a compound represented by Formula 1 below, and the compound may be a flavoring agent compound that releases incense or flavor ingredients during thermal decomposition.

According to one embodiment of the present disclosure, the composition may include: at least one of a base material (or, base substrate), a solvent, and an additive; and a compound represented by Formula 1 above. As an example of the present disclosure, the composition may be a wallpaper composition and/or a paint composition.

According to one embodiment of the present disclosure, the composition, for example, when applied to wallpaper or paint, in the event of a fire, may allow flavor ingredients (e.g., lactones or menthols) according to thermal decomposition by combustion heat to be expressed and rapidly diffused in buildings (e.g., houses, apartments, and factories), and this may provide flavor signals that humans may recognize the fire. In normal cases, soot and products of combustion along with smoke are spread only when wallpaper, furniture, etc. are burned at high temperatures by fire, but if there is a condition where there are ingredients that are thermally decomposed, a fire may be recognized earlier, and rapid evacuation may be possible. For example, when exposed to or approaching an ignition point (heat source), the part to which the composition according to the present disclosure is applied receives high heat as it is closer to the ignition point, and the synthetic compound that is thermally decomposed by heat is thermally decomposed to express a lactone compound and spreads throughout the building space. Such a volatile lactone compound may be quickly recognized by a person in a space away from the flame.

According to one embodiment of the present disclosure, the compound represented by Formula 1 below may express volatile flavor ingredients by thermal decomposition when heat is applied.

[Formula 1]

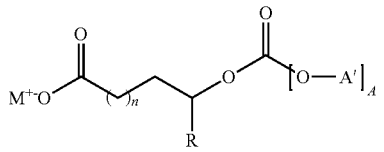

As an example of the present disclosure, the flavoring compound in Formula 1 is covalently bonded with a carbonate linking group

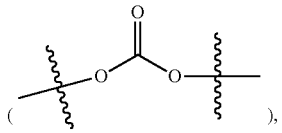

and when heat is applied, the compound of Formula 1 is thermally decomposed to be decomposed into a flavoring compound and a lactone compound so that flavor ingredients may be expressed. For example, the compound of Formula 1 reacts with a hydroxyl group of the flavoring compound through a ring opening mechanism of a lactone-based compound to covalently bond the flavoring compound through a carbonate linking group. It may act as a protecting group to prevent conversion to lactone compounds due to ring closure at room temperature (rt) and/or a temperature close thereto. The compound of Formula 1 has structural stability at about room temperature (rt) or a temperature close thereto, has low volatility, and receives heat to break the carbonate linking group with a ring closing mechanism so that the compound of Formula 1 may be decomposed into a lactone-based compound and a flavoring compound to express flavor. Carbon dioxide which is harmless to the human body may be generated during the decomposition process. That is, the carbonate linking group is broken by heat so that the compound of Formula 1 is decomposed into flavoring compounds, and carbon dioxide may be generated. Next, due to ring closure, the compound of Formula 1 may be decomposed into lactone-based compounds to express flavor.

According to one embodiment of the present disclosure, in Formula 1, n may be an integer of 1 or 2. R may be a straight-chain or branched-chain alkyl having 1 to 30 carbon atoms, and preferably a straight-chain or branched-chain alkyl having 2 to 10 carbon atoms.

According to one embodiment of the present disclosure, moiety A in Formula 1 may be a moiety derived from a flavoring compound having at least one of an aromatic ring having a hydroxyl group, an aliphatic ring having a hydroxyl group, and an aliphatic chain having a hydroxyl group. The hydroxyl group may include one or more (e.g., one or two) in a ring, a chain, or both thereof. This may correspond to a hydroxyl group-containing substituent, a basic backbone, and/or a moiety. The hydroxyl group participates in the carbonate linking group in Formula 1, and A' may correspond to a flavoring compound excluding the hydroxyl group. That is, since the hydroxyl group of the flavoring compound in moiety A is protected with a carbonate linking group, a decomposition reaction may be prevented by ring-closure at room temperature.

According to one embodiment of the present disclosure, the flavoring compound may be selected from a cyclic monoterpene-based compound having a hydroxyl group, a monoterpene-based acyclic compound having a hydroxyl group, a $C_6$-$C_{10}$ aromatic compound having a hydroxyl group, a $C_5$-$C_{10}$ or $C_5$-$C_6$ non-aromatic ring having a hydroxyl group, and isomers thereof. For example, the flavoring compound may be selected from the formulas below and may be a compound which is produced when the carbonate linking group of Formula 1 is broken during thermal decomposition.

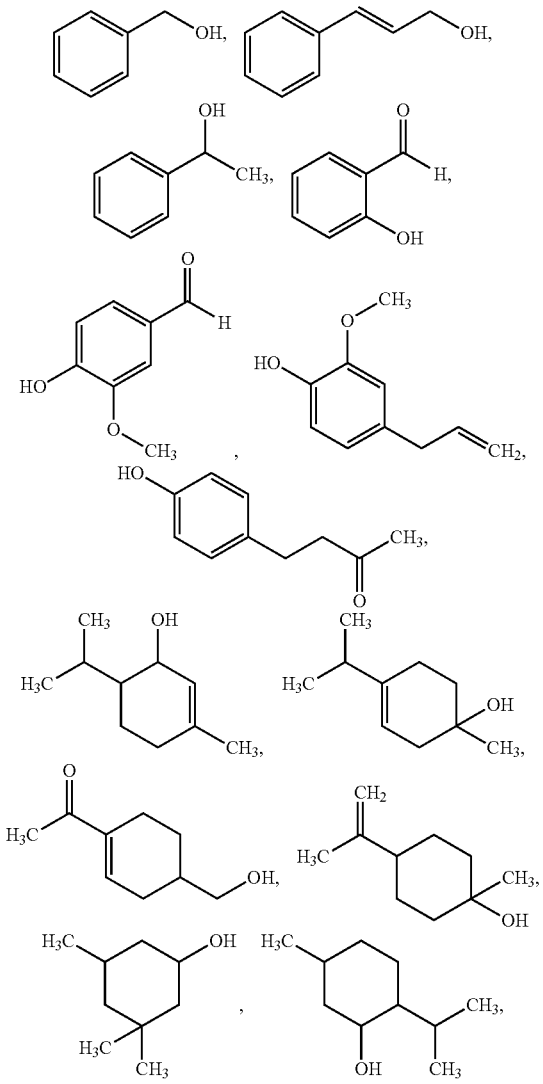

-continued
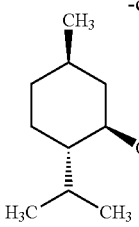
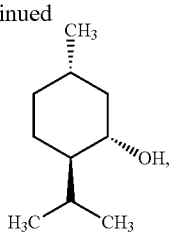
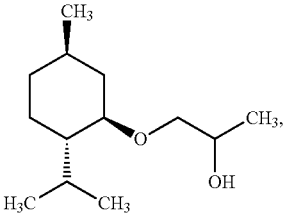
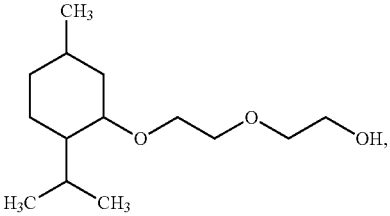
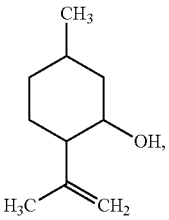
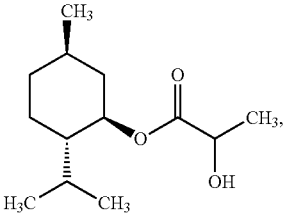
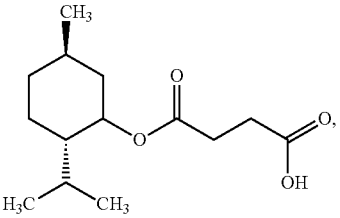
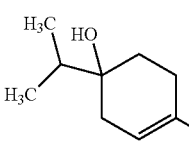
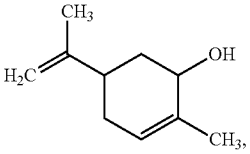
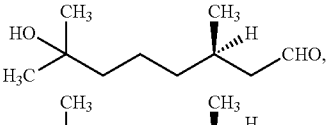
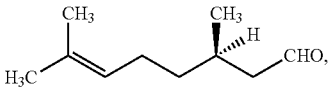
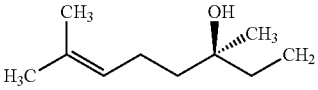
and
-continued
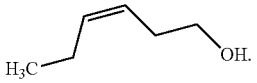
According to one embodiment of the present disclosure, A' in the moiety A may be selected from the formulas below. Here, * corresponds to the oxygen position in the carbonate linking group.
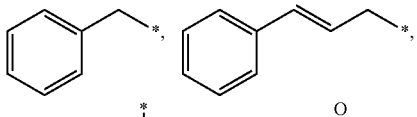
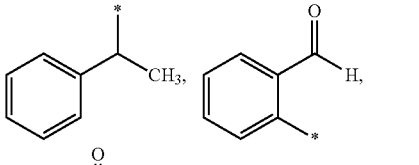
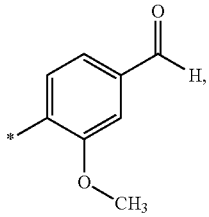
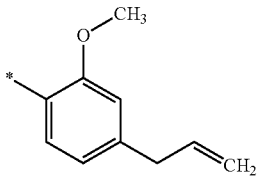
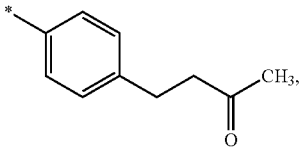
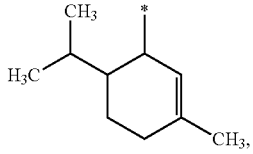
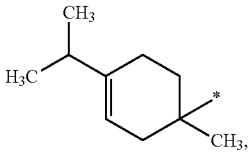
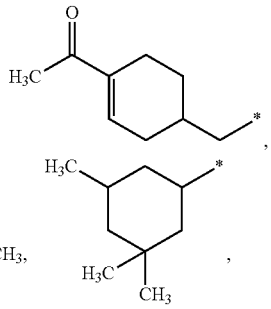
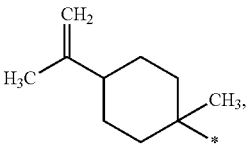
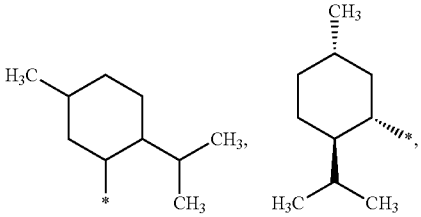
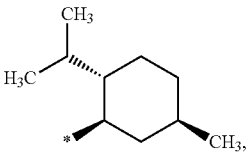
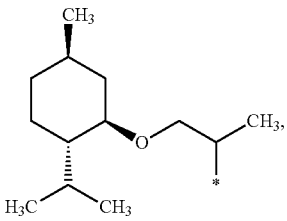

-continued

According to one embodiment of the present disclosure, M is selected from an alkali metal and a transition metal, and M may form a salt with oxygen of an ester group to increase solubility in water-soluble solvents, and to facilitate the application to food, smoking articles, wallpaper, etc. For example, the transition metal may be selected from Zr, Mg, Ca, Co, Rh, Ir, Nb, Pd, Pt, Fe, Ru, Os, Cr, Mo, W, Mn, Tc, Re, Cu, Ag, and Au. For example, the alkali metal may be selected from Li, Na, K, Rb, and Cs. For example, M may be a metal that forms a monovalent cation and may be selected from Li, Na, and K.

According to one embodiment of the present disclosure, the lactone compound may be gamma lactone of Formula 2 below or delta lactone of Formula 3 below.

[Formula 2]

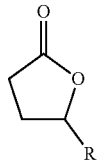

[Formula 3]

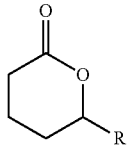

As an example of the present disclosure, R in Formulas 1 and 2 may be a straight-chain or branched-chain alkyl group having 1 to 30 carbon atoms, preferably a straight-chain or branched-chain alkyl group having 2 to 10 carbon atoms.

According to one embodiment of the present disclosure, the lactone compound may be selected from the formulas below.

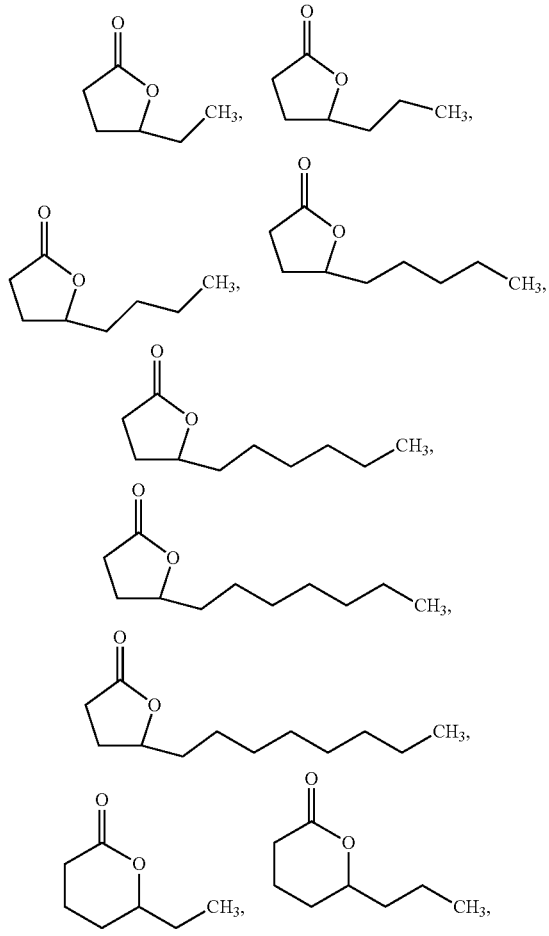

-continued
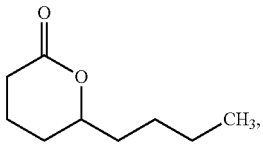
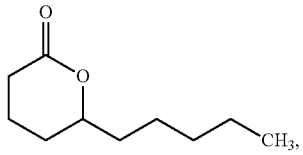
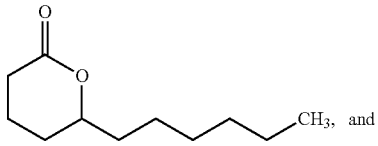
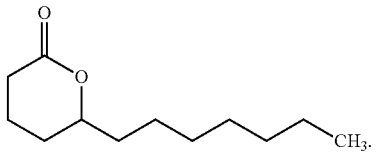
According to one embodiment of the present disclosure, the compound may be selected from Formulas 1-1 to 1-26 below.
[Formula 1-1]
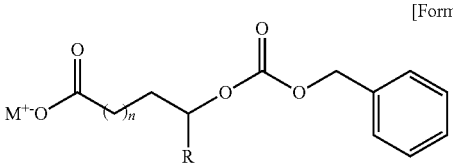
[Formula 1-2]
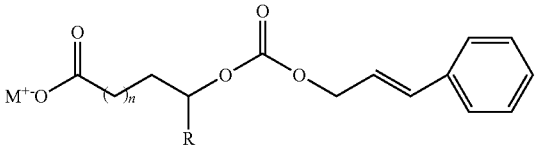
[Formula 1-3]
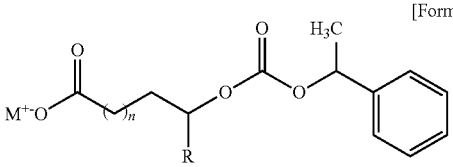
[Formula 1-4]
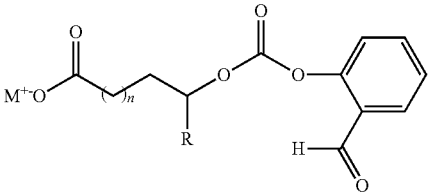
[Formula 1-5]
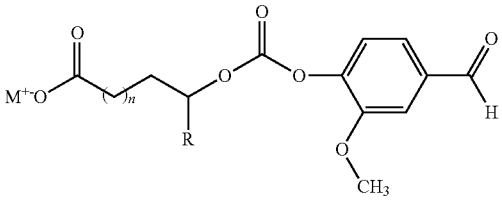
-continued
[Formula 1-6]
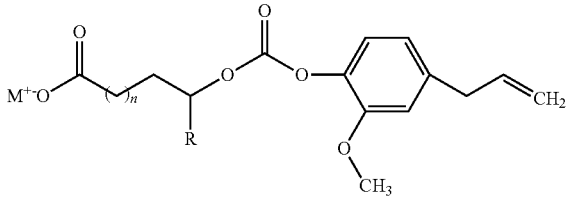
[Formula 1-7]
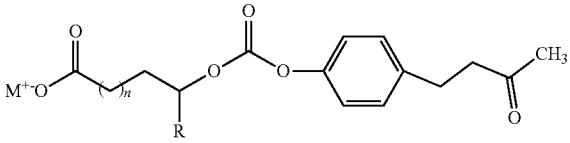
[Formula 1-8]
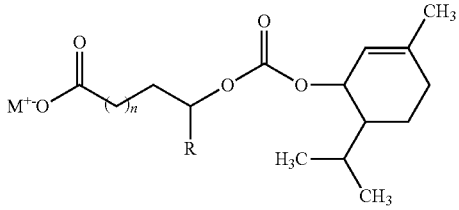
[Formula 1-9]
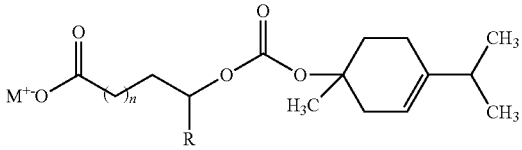
[Formula 1-10]
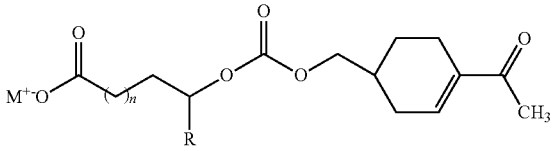
[Formula 1-11]
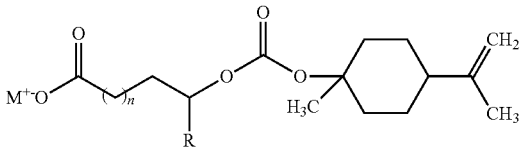
[Formula 1-12]
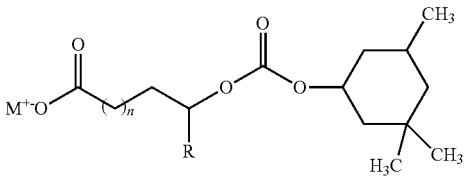
[Formula 1-13]
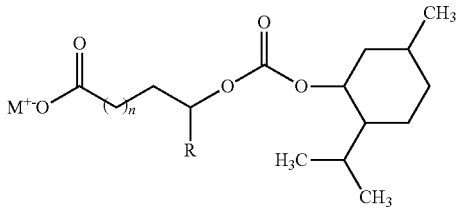

-continued

[Formula 1-14]

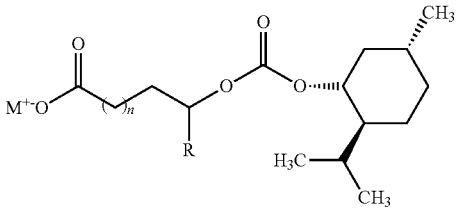

[Formula 1-15]

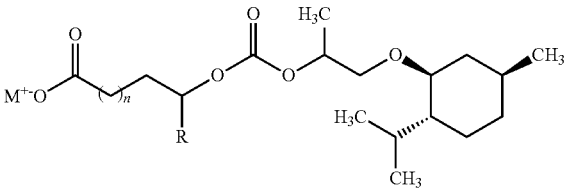

[Formula 1-16]

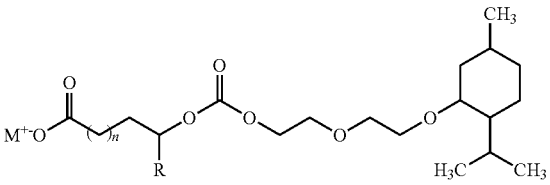

[Formula 1-17]

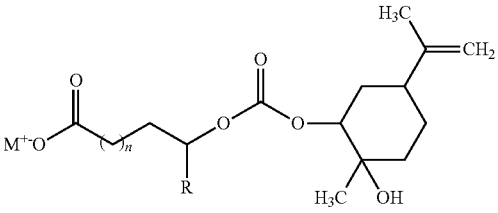

[Formula 1-18]

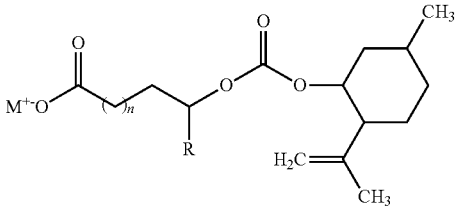

[Formula 1-19]

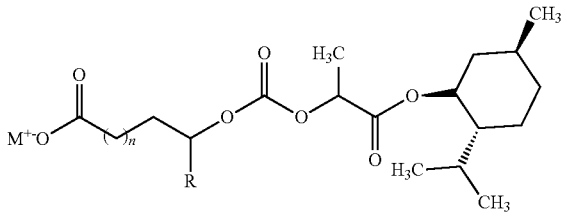

[Formula 1-20]

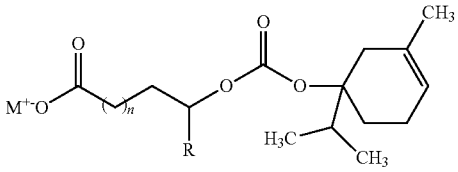

-continued

[Formula 1-21]

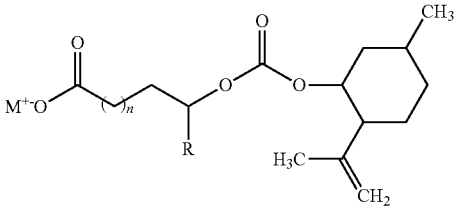

[Formula 1-22]

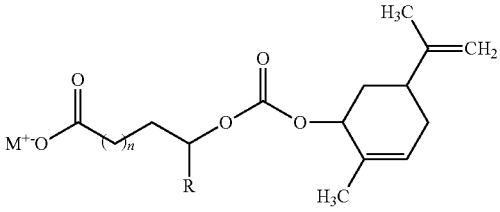

[Formula 1-23]

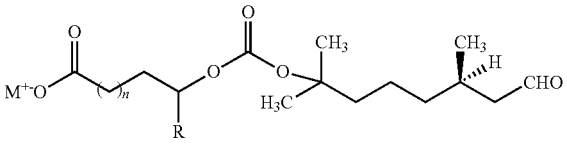

[Formula 1-24]

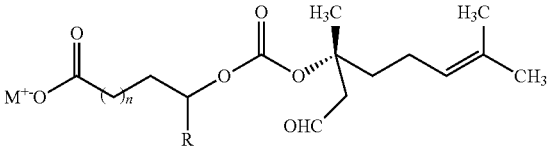

[Formula 1-25]

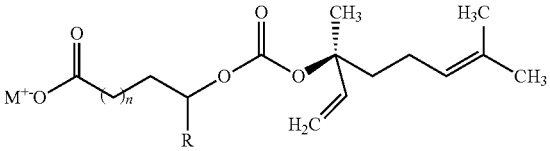

[Formula 1-26]

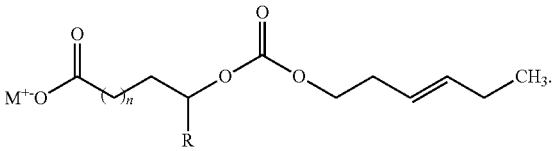

(Here, M and R are as defined in Formula 1 above.)

According to one embodiment of the present disclosure, the compound may be thermally decomposed at a temperature of 70° C. or higher; 80° C. or higher; 90° C. or higher; or 100° C. or higher, preferably 120° C. or higher, 150° C. or higher, or 200° C. or higher, and more preferably 200° C. to 300° C. In addition, the compound may be thermally decomposed in an environment containing oxygen and/or moisture.

According to one embodiment of the present disclosure, the compound may be contained in the composition in an amount of: 0.0001 wt % or more; 0.001 wt % or more; 0.01 wt % or more; 0.1 wt % to 100 wt % (or, exclusive of 100); 0.1 wt % to 80 wt %; 0.0001 wt % to 60 wt %; 0.001 wt % to 50 wt %; 0.1 wt % to 30 wt %; 1 wt % to 20 wt %; 5 wt % to 20 wt %; or 5 wt % to 10 wt %. Preferably, the compound may be contained in an amount of 0.0001 wt % to 1 wt %. Within the above range, the flavor expression function according to the thermal decomposition of the flavoring agent may be obtained, and when the compound is exposed to a temperature that affects the thermal decomposition of the compound with the temperature being exposed to the ignition point or close thereto, or when the substrate is directly combusted and/or ignited, the expression of flavor (e.g., volatile lactone and/or flavor compounds thermally decomposed by the compound of Formula 1) may provide a function capable of recognizing fire caused by humans.

According to one embodiment of the present disclosure, the base material (or base substrate) may be contained in the composition in an amount of: 1 wt % to 100 wt % (exclusive of 100); 30 wt % to 99 wt %; 50 wt % to 99 wt %; 60 wt % to 90 wt %; 80 wt % to 90 wt %; 30 wt % to 60 wt %; or 30 wt % to 50 wt %, and may provide a function as a matrix capable of providing or controlling appropriate mechanical, physical and/or chemical properties according to the use of the composition. For example, when the base material includes two or more types, the mass ratio of the first component to the remaining components may be 1:0.01 to 100; 1:0.1 to 20; 1:0.1 to 10; or 1:0.1 to 5.

According to one embodiment of the present disclosure, the base material (or base substrate) may be appropriately selected depending on the use of the composition, and may be, for example, a material applicable to wallpaper and/or paint. For example, it may be fiber, paper, pulp, wood flour, polymer resin, wood, starch powder, alginic acid, oil, wax, fatty acid, or organic and/or inorganic or ceramic powder, but is not limited thereto. For example, it may be in the form of fibers, or powders.

According to one embodiment of the present disclosure, the organic and/or inorganic or ceramic powder may be chalk, perlite, vermiculite, diatomaceous earth, colloidal silica, oxide magnesium, magnesium sulfate, magnesium carbonate, diatomaceous earth powder, ocher powder, clay powder, rice hull powder, charcoal, waste shell powder, elvan, activated carbon powder, zeolite powder, activated clay powder, silica, titanium dioxide, etc., and it may be used as a base material or functional filler according to the content.

According to one embodiment of the present disclosure, the oil may be vegetable oil, petroleum oil (e.g., paraffinic oil, and mineral oil), animal oil, fatty acid (e.g., an animal fat having 1 to 50 carbon atoms, a vegetable fat having 1 to 50 carbon atoms, a saturated fatty acid having 1 to 50 carbon atoms, and an unsaturated fatty acid having 1 to 50 carbon atoms (e.g., mono- or poly-unsaturated fatty acids)), etc., but is not limited thereto. The wax is made of higher fatty acids and higher alcohols, and the wax may be animal wax, vegetable wax, synthetic wax, petroleum wax, etc., and may be, for example, paraffin wax, Lanolin wax, carnauba wax, Cera, beeswax, PE wax, and PP wax, but is not limited thereto.

According to one embodiment of the present disclosure, the starch powder may be vegetable starch, modified starch, and the like. For example, the vegetable starch may include corn starch, potato starch, sweet potato starch, tapioca starch, and cassava starch; and modified starches. For example, the modified starches may be oxidized starch, acetylated distarch adipate, acetylated distarch phosphate, starch sodium octenyl succinate, distarch phosphate, monostarch phosphate, phosphated distarch phosphate, starch acetate, hydroxypropyl distarch phosphate, and hydroxypropyl starch, but is not limited thereto.

According to one embodiment of the present disclosure, the polymer resin may be a cellulose-based resin, polylactic acid (PLA), polyhydroxy alkanoate (PHA), polyvinyl acetate resin, PVC, TPU, EVA, PP, PE (low density and high density), PET, polyvinyl chloride (PVC), or the like, or it may be a liquid resin. For example, the polymer resin may have a binder function. For example, the cellulose-based resin provides a polymer matrix, and may be, for example, methyl cellulose, ethyl cellulose, carboxymethyl cellulose, carboxyethyl cellulose, hydroxymethyl cellulose, hydroxyethyl cellulose, hydroxypropyl cellulose, hydroxypropyl methylcellulose, hydroxyethyl methylcellulose, agar, and sodium carboxymethyl cellulose (CMC), but is not limited thereto. For example, the cellulose-based resin may be microfibrillated cellulose (e.g., thickness: 20 μm to 300 μm).

According to one embodiment of the present disclosure, the fibers may include short fibers, long fibers, fabrics or pulverized materials of the fabrics, non-woven fabrics, felts, etc., and these may be manufactured of synthetic component yarns and/or natural component yarns. For example, the fibers may be natural fibers of hemp, flax, ramie, kenaf, jute, cotton, banana, fiber, banana fiber, pulp fiber, and bamboo fiber. For example, the long fibers may include PLA long fibers and aliphatic polyester copolymer long fibers. The aliphatic polyester copolymer may be polyethylene succinate, polyethylene adipate, polyethylene azelate, polybutylene oxalate, polybutylene succinate, polybutylene adipate, polybutylene succinate adipate, polybutylene sebacate, or the like, but is not limited thereto.

According to one embodiment of the present disclosure, the solvent may be contained in the remaining amount or the composition in an amount of: 1 to 99 wt %; 10 to 90 wt %; 10 to 80 wt %; 10 to 60 wt %; or 10 to 30 wt %, and the solvent may be water, a water-soluble organic solvent, or an oil-soluble organic solvent, and the solvent may be appropriately selected depending on the use, preferably applied without limitation as long as it is applicable to the wallpaper or paint. For example, it may be an alcohol having 1 to 5 carbon atoms, water, and a glycol-based solvent, but is not limited thereto. For example, the glycol-based solvent may be ethylene glycol butyl ether, ethylene glycol, ethylene glycol monoacetate, diethylene glycol, diethylene glycol acetate, tetraethylene glycol, propylene glycol, propylene glycol monomethyl ether, and trimethylene glycol.

According to one embodiment of the present disclosure, the composition may further include, depending on the use, additives including a solvent, a binder, rubber (natural rubber, epoxy-modified natural rubber and synthetic rubber), a surfactant, a diluent, a decomposing agent, a lubricant, a flavoring agent, a colorant, a preservative, an antioxidant, an emulsifier, a stabilizer, a flavor enhancer, a foaming agent, a filler, an antibacterial agent, a plasticizer, a wetting agent (e.g., glycerin or propylene glycol), and an acetate compound, and the additives may be selected from those known in the art of the present disclosure, and are not specifically mentioned in this document.

According to one embodiment of the present disclosure, the composition is prepared in various phases, and it may be, for example, a solid phase (e.g., powder, crystal, flake, and pulverized material), a slurry, a suspension, a paste, a gel, a liquid phase, an emulsion, or an aerosol. For example, the composition may be molded, mixed into a desired product, or applied in a manner known in the art of the present disclosure, such as application (painting), printing, dipping, spraying and/or coating, and this is not specifically mentioned in this document.

According to one embodiment of the present disclosure, the composition may be molded in the form of a film, sheet, or the like, or applied to a substrate by a method such as coating, dipping, printing, or application. The substrate may be applied without limitation as long as the composition is applicable. For example, when used as a building structure and interior material, the substrate may be concrete, reinforced concrete, cement molding, brick, plywood, wood, gypsum board, tile, stone, a sink, furniture, and wallpaper, and may be applied to electronic products, machinery, and equipment.

According to one embodiment of the present disclosure, the composition may be used as a paint finishing composition for architecture, interior accessories, etc., and may be, for example, sofas, windows, doors, furniture, and wallpaper (e.g., interior sheets). In addition, for example, the composition may be coated on wallpaper base paper.

According to one embodiment of the present disclosure, the interior products or accessories may correspond to interior and exterior materials for construction, household use, and industries such as automobiles, aviation, ships, and trains. For example, it may be a finishing material for automobiles, aviation, and trains.

According to one embodiment of the present disclosure, the composition may be used as wallpaper and/or paint, the wallpaper may be, for example, a wallpaper sheet or film molded with the composition, and the wallpaper may be, for example, a form in which liquid wallpaper (e.g., paint wallpaper) is applied, dried, and finished.

According to one embodiment of the present disclosure, the paint may be a water-soluble/oil-soluble paint, and preferably a water-soluble paint. For example, the paint may provide wallpaper feeling after application on a substrate.

According to one embodiment of the present disclosure, the wallpaper and/or paint includes the compound represented by Formula 1 according to the present disclosure, the "compound represented by Formula 1" according to the present disclosure may be contained as an additive in advance when manufacturing wallpaper so that wallpaper is manufactured, or it may be contained as an additive in paint so that the "compound represented by Formula 1" may also be applied together when the paint is applied to wall, wood, or furniture. At this time, when the heat due to a fire is transmitted, the flavor ingredients (e.g., lactone, and menthol) in the "compound represented by Formula 1" may be thermally decomposed and expressed by a certain degree of high temperature (e.g., about 200° C. to 300° C.). At this time, the volatile flavor ingredients diffuse from a part close to the flame of the building where the fire occurred and spreads throughout the building so that, when a person at a distance sniffs the characteristic lactone/menthol flavors, it may be recognized that a fire has broken out. In normal cases, soot and combustion products are diffused along with smoke only when wallpaper and furniture are burned due to high temperatures by fire. However, if there are conditions where there are ingredients that are thermally decomposed, the fire may be recognized earlier.

As an example of the present disclosure, the paint may be used for building structures, interior products, accessories, electronic products, automobiles, aviation, trains, and the like. The interior products may be used for the above-mentioned household and industrial parts, etc.

As an example of the present disclosure, the wallpaper may have a thickness of: 0.1 mm or more; 0.1 mm to 5 mm; 0.1 mm to 3 mm; 0.1 mm to 2 mm; 0.1 mm to 1 mm; or 1 mm to 2 mm.

As an example of the present disclosure, the wallpaper may consist of a single layer or multiple layers, and may include, for example, a base sheet, a resin layer, and a printing layer, but is not limited thereto. In addition, the composition according to the present disclosure may be sprayed, printed and/or coated on the base paper of the wallpaper.

Hereinafter, the present disclosure will be described in more detail by examples and comparative examples. However, the following examples are only for illustrating the present disclosure, and the content of the present disclosure is not limited to the following examples.

Example 1

1. Synthesis of Sodium(4-mentylcarbonyloxy)heptanoate (5a)

[Reaction Formula 1]

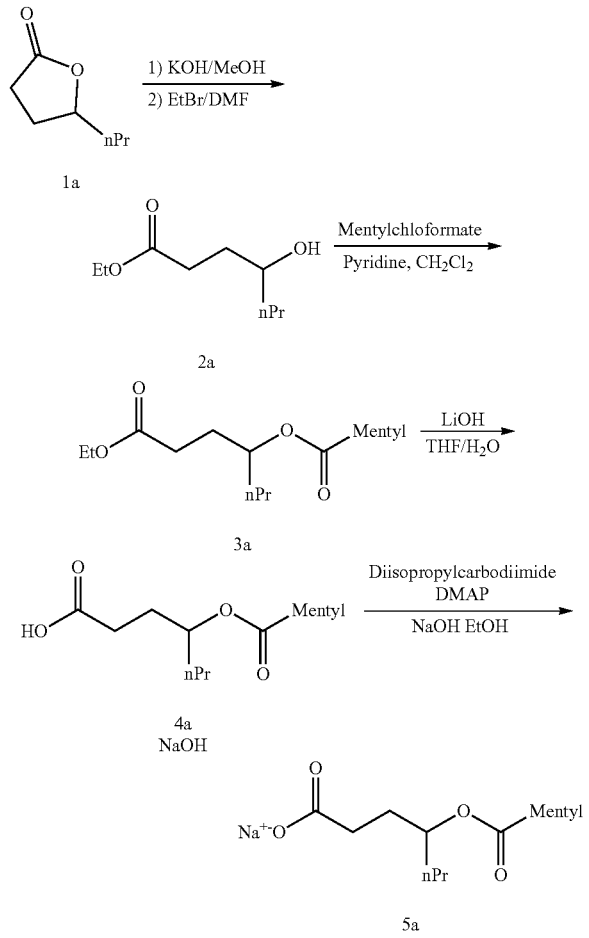

(1-1) Synthesis of ethyl 4-hydroxyheptanoate (2a)

20 g (0.15 mol) of γ-heptalactone was dissolved in 100 mL of methanol, and while stirring the dissolved solution, 11.17 g (0.16 mol, 1.05 eq.) of KOH was slowly put thereinto and reacted at room temperature for 12 hours. After concentrating the reaction solution under reduced pressure, 80 mL of DMF was put thereinto, and while stirring the mixed solution, 17 g (0.15 mol, 1 eq.) of bromoethane was put thereinto, and reacted for 12 hours. 100 mL of water was put into the reaction solution, extracted with ethyl acetate, and then washed with water and brine. The organic layer was dried over $MgSO_4$ and then concentrated under reduced pressure to obtain 18.1 g (66.7%, 2 steps) of the target product 2a.

$^1$H NMR ($CDCl_3$, 400.13 MHz); δ 8.01 (s, 1H, —OH), 4.12 (q, 2H, J=8 Hz, COO—$CH_2$—), 3.63 (m, 1H, CH—O), 2.42 (m, 2H, CO—$CH_2$), 1.81~0.92 (m, 12H, alkyl)

(1-2) Synthesis of ethyl 4-(mentylcarbonyloxy)heptanoate (3a)

18 g (0.1 mol) of ethyl 4-hydroxyheptanoate (2a) was dissolved in 120 mL of THF, 16 g (0.2 mol, 2 eq.) of pyridine was put into the dissolved solution and cooled with ice water, and while stirring the cooled mixed solution, 23 g (0.1 mol, 1 eq.) of mentyl chloroformate and 20 mL of THF were slowly dropped thereinto. After 1 hour, the reaction solution was raised to room temperature and reacted overnight, and then water was put thereinto and extracted with ethyl acetate. The organic layer was washed with dilute hydrochloric acid, a saturated sodium bicarbonate solution, and brine, respectively, dried over $MgSO_4$, and concentrated under reduced pressure to obtain 30 g (yield of 81%) of the target product 3a as a yellow liquid.

$^1$H NMR ($CDCl_3$, 400.13 MHz); δ 4.74 (7 tet, 1H, J=4 Hz, —COOCH—), 4.51 (td, 1H, J=9, 4 Hz, COO—CH—), 4.12 (q, 2H, J=8 Hz, COO—$CH_2$—), 2.36 (m, 2H, CO—$CH_2$—), 1.93 to 0.79 (m, 30H, alkyl)

(1-3) Synthesis of 4-(mentylcarbonyloxy)heptanoic acid (4a)

25 g (68.5 mmol) of ethyl 4-(mentylcarbonyloxy) heptanoate (3a) was dissolved in 100 mL of THF and 30 mL of distilled water, and 4.2 g (102.4 mmol, 1.5 eq.) of lithium hydroxide monohydrate was put into the dissolved solution and reacted at room temperature for 12 hours. 50 mL of distilled water was added to the reaction solution and extracted with ether. The aqueous layer was adjusted to pH 3 by putting concentrated hydrochloric acid thereinto and then extracted with ethyl acetate. After the organic layer was washed with brine, the washed organic layer was dried over $MgSO_4$ and concentrated under reduced pressure to obtain 21.8 g (yield of 81%) of the target product 4a as a yellow liquid.

$^1$H NMR ($CDCl_3$, 400.13 MHz); δ 4.76 (m, 1H, —COOCH—), 4.52 (td, 1H, J=9, 4 Hz, COO—CH—), 4.11 (q, 2H, J=8 Hz, COO—$CH_2$—), 2.42 (m, 2H, CO—$CH_2$—), 1.99 to 0.82 (m, 27H, alkyl)

(1-4) Synthesis of Sodium(4-mentylcarbonyloxy)heptanoate (5a)

2.5 g (7.5 mmol) of 4-(mentylcarbonyloxy) heptanoic acid (4a) was dissolved in 20 mL of 95% ethanol, and 0.29 g (0.95 eq.) of 98% NaOH was put into the dissolved solution, and stirred at room temperature for 2 hours. Water and ethanol were blown away using the azeotropic phenomenon, toluene was added to remove water, and then hexane and ethyl acetate were put thereinto and filtered to obtain a white solid.

2. Synthesis of Sodium 4-(mentylcarbonyloxy)nonanoate (5b)

[Reaction Formula 2]

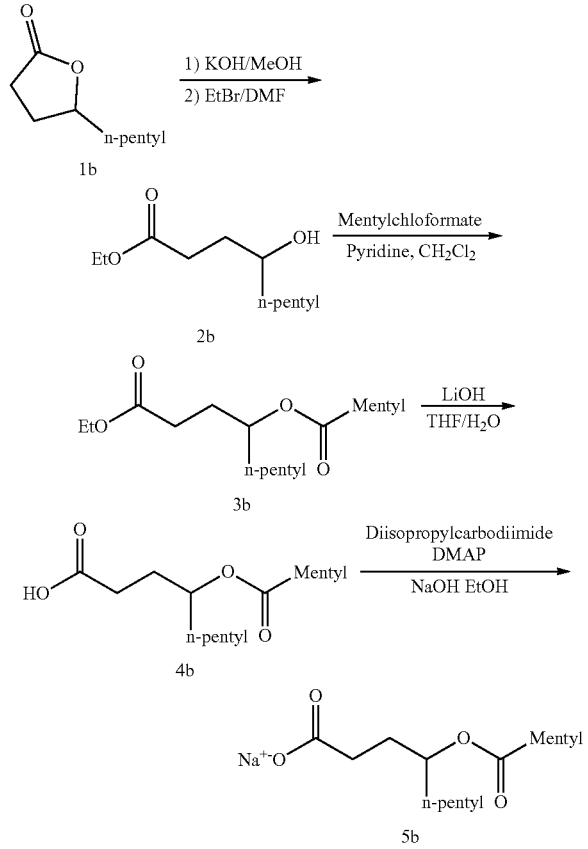

(2-1) Synthesis of ethyl 4-hydroxynonanoate (2b)

20 g (0.13 mol) of γ-nonalactone was dissolved in 100 mL of methanol, and while stirring the dissolved solution, 9.18 g (0.14 mol, 1.05 eq.) of KOH was slowly put thereinto and reacted at room temperature for 12 hours. After concentrating the reaction solution under reduced pressure, 80 mL of DMF was put thereinto, and while stirring the mixed solution, 14 g (0.13 mol, 1 eq.) of bromoethane was put thereinto, and reacted for 12 hours. 100 mL of water was put into the reaction solution, extracted with ethyl acetate, and then washed with water and brine. The organic layer was dried over $MgSO_4$ and then concentrated under reduced pressure to obtain 24 g (93%, 2 steps) of the target product 2b.

(2-2) Synthesis of ethyl 4-(mentylcarbonyloxy)nonanoate (3b)

24 g (0.12 mol) of ethyl 4-hydroxynonanoate (2b) was dissolved in 120 mL of THF, 18 g (0.42 mol, 2 eq.) of pyridine was put into the dissolved solution and cooled with ice water, and while stirring the cooled mixed solution, 26 g (0.12 mol, 1 eq.) of mentyl chloroformate and 30 mL of THF were slowly dropped thereinto. After 1 hour, the reaction solution was raised to room temperature and reacted overnight, and then water was put thereinto and extracted with ethyl acetate. The organic layer was washed with dilute hydrochloric acid, a saturated sodium bicarbonate solution, and brine, respectively, dried over $MgSO_4$, and concentrated under reduced pressure to obtain 34 g (yield of 74.5%) of the target product 3b as a yellow liquid.

$^1$H NMR ($CDCl_3$, 400.13 MHz); δ 4.74 (7 tet, 1H, J=4 Hz, —COOCH—), 4.51 (td, 1H, J=9, 4 Hz, COO—CH—), 4.12 (q, 2H, J=8 Hz, COO—$CH_2$—), 2.36 (m, 2H, CO—$CH_2$—), 1.93 to 0.79 (m, 23H, alkyl)

(2-3) Synthesis of 4-(mentylcarbonyloxy)nonanoic acid (4b)

11.5 g (29.9 mmol) of ethyl 4-(mentylcarbonyloxy) nonanoate (3b) was dissolved in 50 mL of THF and 20 mL of distilled water, and 2 g (48.7 mmol, 1.6 eq.) of lithium hydroxide monohydrate was put into the dissolved solution and reacted at room temperature for 12 hours. 50 mL of distilled water was added to the reaction solution and extracted with ether. The aqueous layer was adjusted to pH 3 by putting concentrated hydrochloric acid thereinto and then extracted with ethyl acetate. After the organic layer was washed with brine, the washed organic layer was dried over $MgSO_4$ and concentrated under reduced pressure to obtain 8.6 g (yield of 80%) of the target product 4b as a yellow liquid.

$^1$H NMR ($CDCl_3$, 400.13 MHz); δ 4.75 (m, 1H, —COOCH—), 4.49 (m, 1H, COO—CH—), 2.04 (m, 2H, CO—$CH_2$—), 1.93 to 0.79 (m, 31H, alkyl)

(2-4) Synthesis of Sodium 4-(mentylcarbonyloxy)nonanoate (5b)

2.5 g (7.5 mmol) of 4-(mentylcarbonyloxy) nonanoic acid (4b) was dissolved in 20 mL of 95% ethanol, and 0.29 g (0.95 eq.) of 98% NaOH was put into the dissolved solution, and stirred at room temperature for 2 hours. Water and ethanol were blown away using the azeotropic phenomenon, toluene was added to remove water, and then 5 hexane and ethyl acetate were put thereinto and filtered to obtain a white solid.

3. Sodium 5-(mentylcarbonyloxy)decanoate (5c)

[Reaction Formula 3]

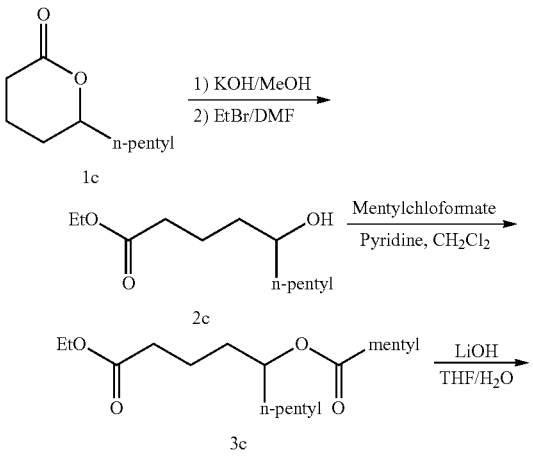

-continued

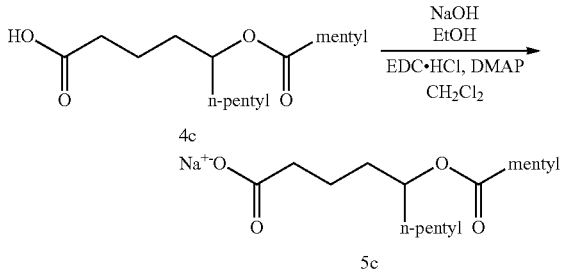

(3-1) Synthesis of ethyl 5-hydroxydecanoate (2c)

10 g (58.7 mmol) of 8-decalactone was dissolved in 50 mL of methanol, and while stirring the dissolved solution, 4.2 g (64.7 mmol, 1.05 eq.) of KOH was slowly put thereinto and reacted at room temperature for 12 hours. After concentrating the reaction solution under reduced pressure, 40 mL of DMF was put thereinto, and while stirring the mixed solution, 6.4 g (58.7 mmol, 1 eq) of bromoethane was put thereinto, and reacted for 12 hours.

100 mL of water was put into the reaction solution, extracted with ethyl acetate, and then washed with water and brine. The organic layer was dried over $MgSO_4$ and then concentrated under reduced pressure to obtain 7.6 g (60%, 2 steps) of the target product 2c.

(3-2) Synthesis of ethyl 5-(mentylcarbonyloxy)decanoate (3c)

7.5 g (34.6 mmol) of ethyl 5-hydroxydecanoate (2c) was dissolved in 50 mL of THF, 5.3 g (69.2 mmol, 2 eq.) of pyridine was put into the dissolved solution and cooled with ice water, and while stirring the cooled mixed solution, 8.3 g (37.9 mmol, 1.1 eq.) of methyl chloroformate and 20 mL of THF were slowly dropped thereinto. After 1 hour, the reaction solution was raised to room temperature and reacted overnight, and then water was put thereinto and extracted with ethyl acetate. The organic layer was washed with dilute hydrochloric acid, a saturated sodium bicarbonate solution, and brine, respectively, dried over $MgSO_4$, and concentrated under reduced pressure. The mixture was subjected to silica gel column chromatography using a mixed solvent of n-hexane and ethyl acetate (7:1) to obtain 4.5 g (yield of 32.6%) of the target product 3c.

$^1$H NMR ($CDCl_3$, 400.13 MHz); § 4.72 (m, 1H, —COOCH—), 4.52 (m, 1H, COO—CH—), 4.12 (q, 2H, J=8 Hz, COO—$CH_2$—), 2.31 (t, 2H, J=8 Hz, CO—$CH_2$—), 2.08 to 0.86 (m, 27H, alkyl), 0.79 (d, 6H, J=8 Hz, —$CH_3$).

(3-3) Synthesis of 5-(mentylcarbonyloxy)decanoic acid (4c)

2.7 g (6.8 mmol) of ethyl 4-(mentylcarbonyloxy) nonanoate (3c) was dissolved in 20 mL of THF and 10 mL of distilled water, and 0.42 g (10.2 mmol, 1.5 eq.) of lithium hydroxide monohydrate was put into the dissolved solution and reacted at room temperature for 12 hours. 10 mL of distilled water was added to the reaction solution and extracted with ether. The aqueous layer was adjusted to pH 3 by putting concentrated hydrochloric acid thereinto and then extracted with ethyl acetate. After the organic layer was washed with brine, the washed organic layer was dried over $MgSO_4$ and concentrated under reduced pressure to obtain 2.1 g (yield of 78%) of the target product 4c as a yellow liquid.

$^1$H NMR ($CDCl_3$, 400.13 MHz); δ 4.72 (m, 1H, —COOCH—), 4.51 (td, 1H, J=8, 4 Hz, COO—CH—), 4.11 (q, 2H, J=8 Hz, COO—$CH_2$—), 2.38 (m, 2H, CO—$CH_2$—), 2.06 to 0.78 (m, 33H, alkyl)

(3-4) Synthesis of Sodium 5-(mentylcarbonyloxy)decanoate (5c)

7.5 mmol of 5-(mentylcarbonyloxy) decanoic acid (4c) was dissolved in 20 mL of 95% ethanol, and 0.29 g (0.95 eq.) of 98% NaOH was put into the dissolved solution, and stirred at room temperature for 2 hours. Water and ethanol were blown away using the azeotropic phenomenon, toluene was added to remove water, and then hexane and ethyl acetate were put thereinto and filtered to obtain a white solid.

4. Synthesis of Sodium(4-mentylcarbonyloxy)undecanoate (5d)

[Reaction Formula 4]

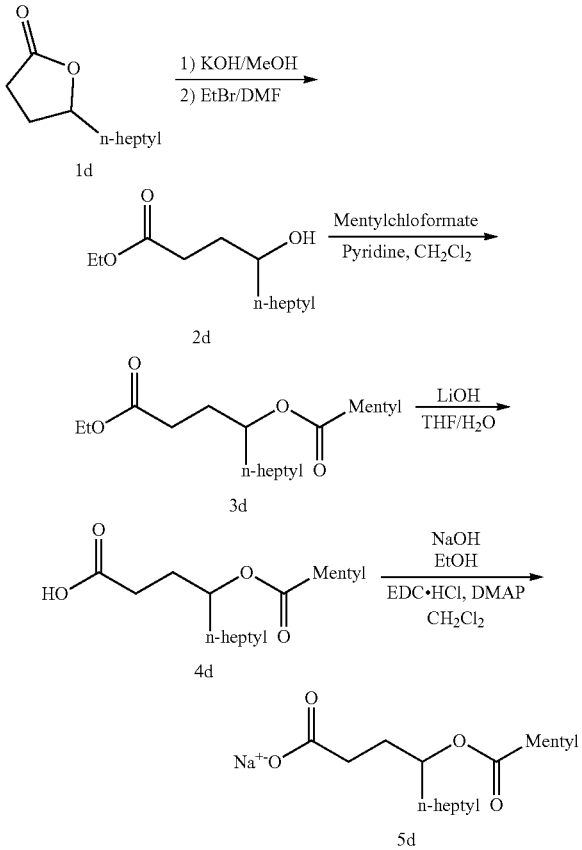

(4-1) Synthesis of ethyl 4-hydroxyundecanoate (2d)

10 g (54.2 mmol) of γ-undecalactone was dissolved in 50 mL of methanol, and while stirring the dissolved solution, 3.9 g (56.9 mmol, 1.05 eq.) of KOH was slowly put thereinto and reacted at room temperature for 12 hours. After concentrating the reaction solution under reduced pressure, 50 mL of DMF was put thereinto, and while stirring the mixed solution, 5.9 g (54.2 mmol, 1 eq.) of bromoethane was put thereinto, and reacted for 12 hours. 80 mL of water was put into the reaction solution, extracted with ethyl acetate, and then washed with water and brine. The organic layer was dried over $MgSO_4$ and then concentrated under reduced pressure to obtain 10.7 g (85.6%, 2 steps) of the target product 2d.

$^1$H NMR ($CDCl_3$, 400.13 MHZ); δ 4.12 (q, 2H, J=8 Hz, COO—$CH_2$—), 3.59 (m, 1H, CH—O), 2.43 (m, 2H, CO—$CH_2$), 1.81 to 0.92 (m, 20H, alkyl) (4-2) Synthesis of ethyl 4-(mentylcarbonyloxy) undecanoate (3d) 11 g (47.7 mmol) of ethyl 4-hydroxyundecanoate (2d) was dissolved in 60 mL of THF, 6.8 g (95.5 mmol, 2 eq.) of pyridine was put into the dissolved solution and cooled with ice water, and while stirring the cooled mixed solution, 10.5 g (47.7 mmol, 1 eq.) of mentyl chloroformate and 20 mL of THF were slowly dropped thereinto. After 1 hour, the reaction solution was raised to room temperature and reacted overnight, and then water was put thereinto and extracted with ethyl acetate. The organic layer was washed with dilute hydrochloric acid, a saturated sodium bicarbonate solution, and brine, respectively, dried over $MgSO_4$, and concentrated under reduced pressure to obtain 8.3 g (yield of 42.1%) of the target product 3d as a yellow liquid.

$^1$H NMR ($CDCl_3$, 400.13 MHz); δ 4.74 (7 tet, 1H, J=4 Hz, —COOCH—), 4.51 (td, 1H, J=9, 4 Hz, COO—CH—), 4.12 (q, 2H, J=8 Hz, COO—$CH_2$—), 2.36 (m, 2H, CO—$CH_2$—), 1.93 to 0.79 (m, 23H, alkyl) (4-3) Synthesis of 4-(mentylcarbonyloxy) undecanoic acid (4d) 8.3 g (19.4 mmol) of ethyl 4-(mentylcarbonyloxy) undecanoate (3d) was dissolved in 30 mL of THF and 20 mL of distilled water, and 1.2 g (29.1 mmol, 1.5 eq.) of lithium hydroxide monohydrate was put into the dissolved solution and reacted at room temperature for 12 hours. 20 mL of distilled water was added to the reaction solution and extracted with ether. The aqueous layer was adjusted to pH 3 by putting concentrated hydrochloric acid thereinto and then extracted with ethyl acetate. After the organic layer was washed with brine, the washed organic layer was dried over $MgSO_4$ and concentrated under reduced pressure. The mixture was subjected to silica gel column chromatography using a mixed solvent of hexane (n-hexane) and ethyl acetate (8:1) to obtain 6.8 g (yield of 91.8%) of the target product 4d.

$^1$H NMR ($CDCl_3$, 400.13 MHz); δ 4.75 (m, 1H, —COOCH—), 4.51 (m, 1H, COO—CH—), 2.43 (m, 2H, CO—$CH_2$—), 2.17 to 0.78 (m, 35H, alkyl)

(4-4) Synthesis of Sodium(4-mentylcarbonyloxy)undecanoate (5d)

2.5 g (7.5 mmol) of 4-(mentylcarbonyloxy) undecanoic acid (4d) was dissolved in 20 mL of 95% ethanol, and 0.29 g (0.95 eq.) of 98% NaOH was put into the dissolved solution, and stirred at room temperature for 2 hours. Water and ethanol were blown away using the azeotropic phenomenon, toluene was added to remove water, and then hexane (n-hexane) and ethyl acetate were put thereinto and filtered to obtain a white solid.

5. Synthesis of Sodium 4-(benzyloxycarbonyloxy)undecanoate (5e)

[Reaction Formula 5]

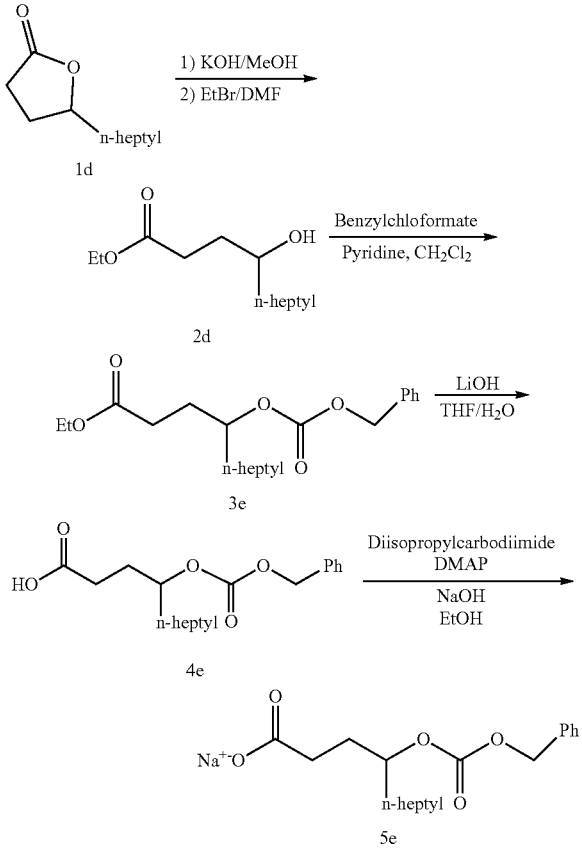

(5-1) Synthesis of ethyl 4-hydroxyundecanoate (2d)

10 g (54.2 mmol) of γ-undecalactone was dissolved in 50 mL of methanol, and while stirring the dissolved solution, 3.9 g (56.9 mmol, 1.05 eq.) of KOH was slowly put thereinto and reacted at room temperature for 12 hours. After concentrating the reaction solution under reduced pressure, 50 mL of DMF was put thereinto, and while stirring the mixed solution, 5.9 g (54.2 mmol, 1 eq.) of bromoethane was put thereinto, and reacted for 12 hours.

80 mL of water was put into the reaction solution, extracted with ethyl acetate, and then washed with water and brine. The organic layer was dried over $MgSO_4$ and then concentrated under reduced pressure to obtain 10.7 g (85.6%, 2 steps) of the target product 2d.

$^1$H NMR ($CDCl_3$, 400.13 MHz); δ 4.12 (q, 2H, J=8 Hz, COO—$CH_2$—), 3.59 (m, 1H, CH—O), 2.43 (m, 2H, CO—$CH_2$), 1.81 to 0.92 (m, 20H, alkyl)

(5-2) Synthesis of ethyl 4-(benzyloxycarbonyloxy)undecanoate (3e)

8.3 g (36 mmol) of ethyl 4-hydroxyundecanoate (2d) was dissolved in 50 mL of THF, 5.5 g (72.3 mmol, 2 eq.) of pyridine was put into the dissolved solution and cooled with ice water, and while stirring the cooled mixed solution, 6.1 g (35.3 mmol, 1 eq.) of benzyl chloroformate and 20 mL of THF were slowly dropped thereinto. After 1 hour, the reaction solution was raised to room temperature and reacted overnight, and then water was put thereinto and extracted with ethyl acetate. The organic layer was washed with dilute hydrochloric acid, a saturated sodium bicarbonate solution, and brine, respectively, dried over $MgSO_4$, and concentrated under reduced pressure to obtain 9.9 g (yield of 75.6%) of the target product 3e as a yellow liquid. $^1$H NMR ($CDCl_3$, 400.13 MHz); δ 7.37 to 7.34 (m, 5H, ph), 5.14 (m, 2H, O—$CH_2$-Ph), 4.12 (brs, 1H, O—CH—), 2.42 (m, 2H, CO—$CH_2$—), 1.90 to 0.79 (m, 21H, alkyl)

(5-3) Synthesis of 4-(benzyloxycarbonyloxy)undecanoic acid (4e)

10 g (27.5 mmol) of ethyl 4-(benzyloxycarbonyloxy) undecanoate (3e) was dissolved in 30 mL of THF and 20 mL of distilled water, and 1.7 g (41.4 mmol, 1.5 eq.) of lithium hydroxide monohydrate was put into the dissolved solution and reacted at room temperature for 12 hours. 20 mL of distilled water was added to the reaction solution and extracted with ether. The aqueous layer was adjusted to pH 3 by putting concentrated hydrochloric acid thereinto and then extracted with ethyl acetate. After the organic layer was washed with brine, the washed organic layer was dried over $MgSO_4$ and concentrated under reduced pressure to obtain 8.2 g (yield of 89%) of the target product 4e.

$^1$H NMR ($CDCl_3$, 400.13 MHz); δ 7.37 to 7.35 (m, 5H, ph), 5.14 (m, 2H, O—$CH_2$-Ph), 4.48 (m, 1H, O—CH—), 2.47 (m, 2H, CO—$CH_2$—), 1.90 to 0.79 (m, 21H, alkyl)

(5-4) Synthesis of Sodium 4-(benzyloxycarbonyloxy)undecanoate (5e)

2.5 g (7.5 mmol) of 4-(benzyloxycarbonyloxy) undecanoic acid (4e) was dissolved in 20 mL of 95% ethanol, and 0.29 g (0.95 eq.) of 98% NaOH was put into the dissolved solution, and stirred at room temperature for 2 hours. Water and ethanol were blown away using the azeotropic phenomenon, toluene was added to remove water, and then hexane (n-hexane) and ethyl acetate were put thereinto and filtered to obtain a white solid.

Experimental Example

A pyrolysis test was conducted to confirm the pyrolytic behavior of the 5d Compound (2B) when exposed to heat, which was observed by a commonly-known pyrolysis-gas chromatography/mass spectrometry [Py-GC/MS]. The pyrolyzer was performed in a system in which the [Double-Shot Pyrolyzer 2020iD] (Frontier Lab, Japan) was connected to the GC/MS (Agilent 6890 GC, USA/Aginelt 7890 MSD, USA) equipment. After diluting 2B to 2.5% concentration in an ethyl alcohol solution, 10 ul was loaded into a pyrolyzer sample cup, and then thermally decomposed. The temperature experienced by the sample was controlled by specifying the temperature of the furnace of the Double-Shot Pyrolyzer for the thermal decomposition temperature. The initial thermal decomposition temperature was set at 80° C. for 30 seconds so that the Target Compound (2B) in the sample cup was allowed to undergo thermal decomposition by exposing the sample cup having a sample placed therein to the furnace. The ingredients produced by heat or volatilized by heat were directly injected into the injector of GC/MS and separated. The sample cup was removed from the furnace during GC/MS analysis after thermal decomposition so that it was not affected by the thermal decomposition temperature, and after the GC/MS analysis by the first thermal decomposition was completed, the sample cup used for the first time was subjected to thermal decomposition again without injecting a new compound thereinto. At this time, the sample cup was subjected to thermal decomposition for 30 seconds at a thermal decomposition temperature of 90° C., which is 10° C. higher. Also, after the thermal decomposition was completed, the sample cup was removed from the furnace so that it was not affected by the thermal decomposition temperature. In this manner, when the first sample was loaded into the sample cup and then thermally decomposed, the thermal decomposition experiment was performed while raising the temperature from 80° C., 90° C., and 100° C. to 320° C. in the end. As a result, it was possible to consider the thermal decomposition characteristics of compounds experienced as the thermal decomposition temperature increased by dividing them by temperature range. The results are shown in FIGS. 15 to 17.

Figure 15:
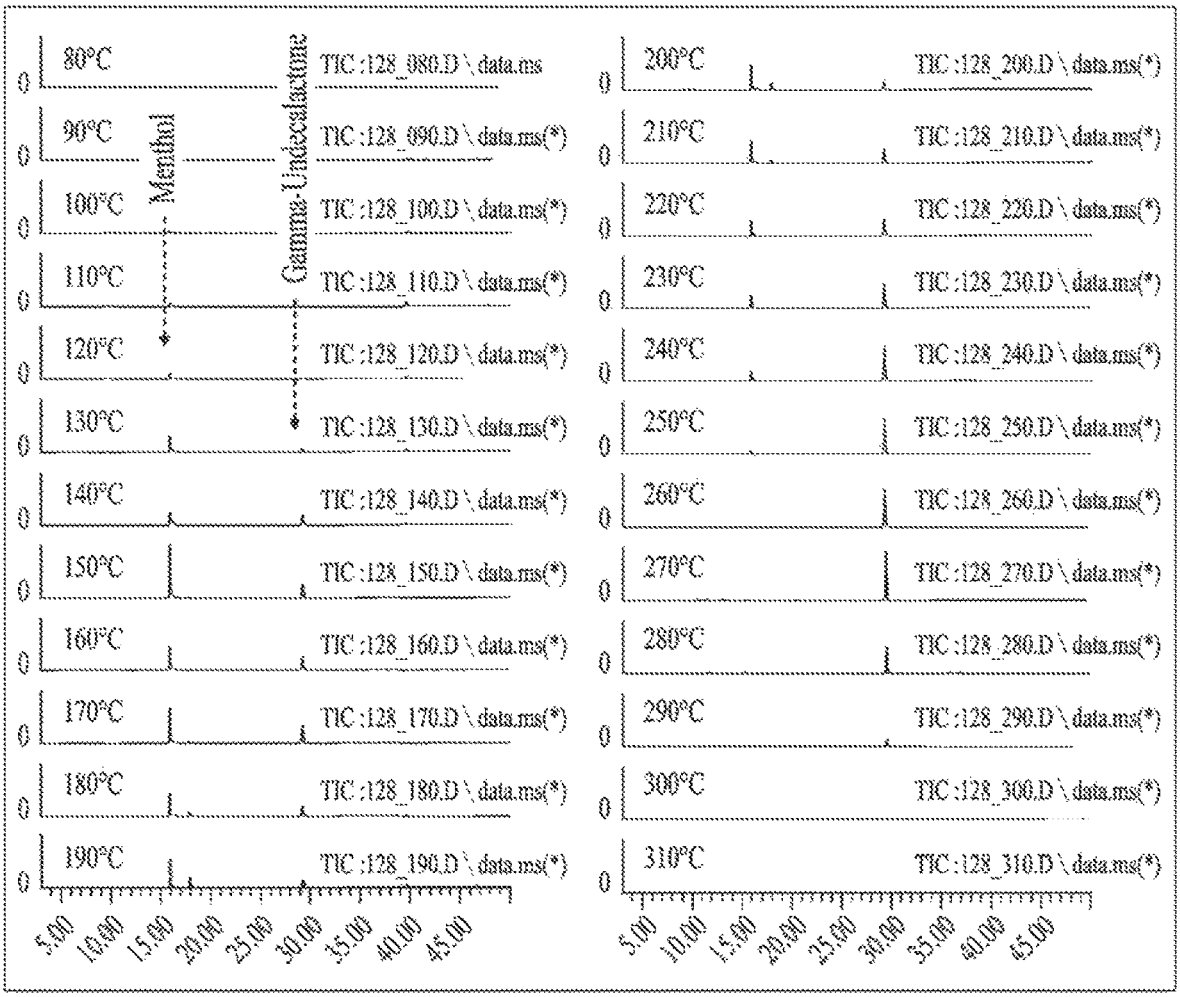
FIG. 15 is a diagram illustrating the results of thermal analysis of sodium (4-mentylcarbonyloxy) undecanoate (5d) prepared in an example according to one embodiment of the present disclosure.
Figure 16:
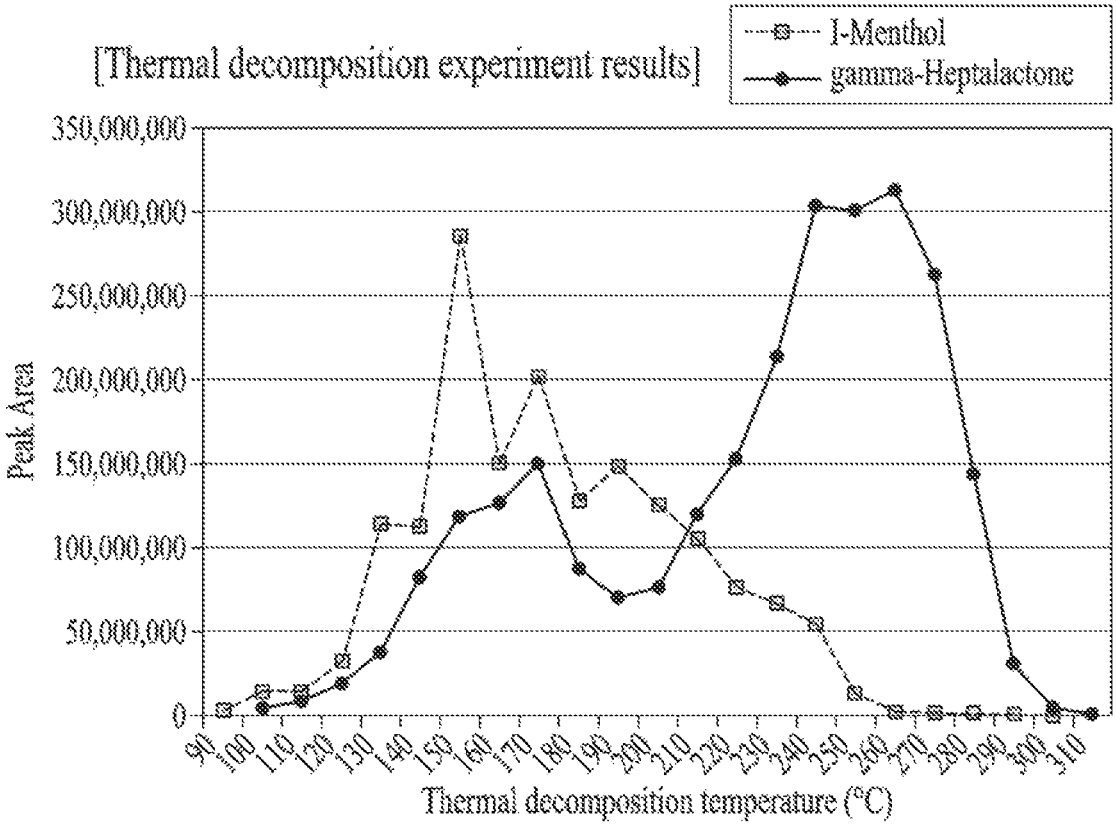
FIG. 16 is a diagram illustrating the distribution of ingredients according to the thermal decomposition temperature of sodium (4-mentylcarbonyloxy) undecanoate (5d) prepared in an example according to one embodiment of the present disclosure.
Figure 17:
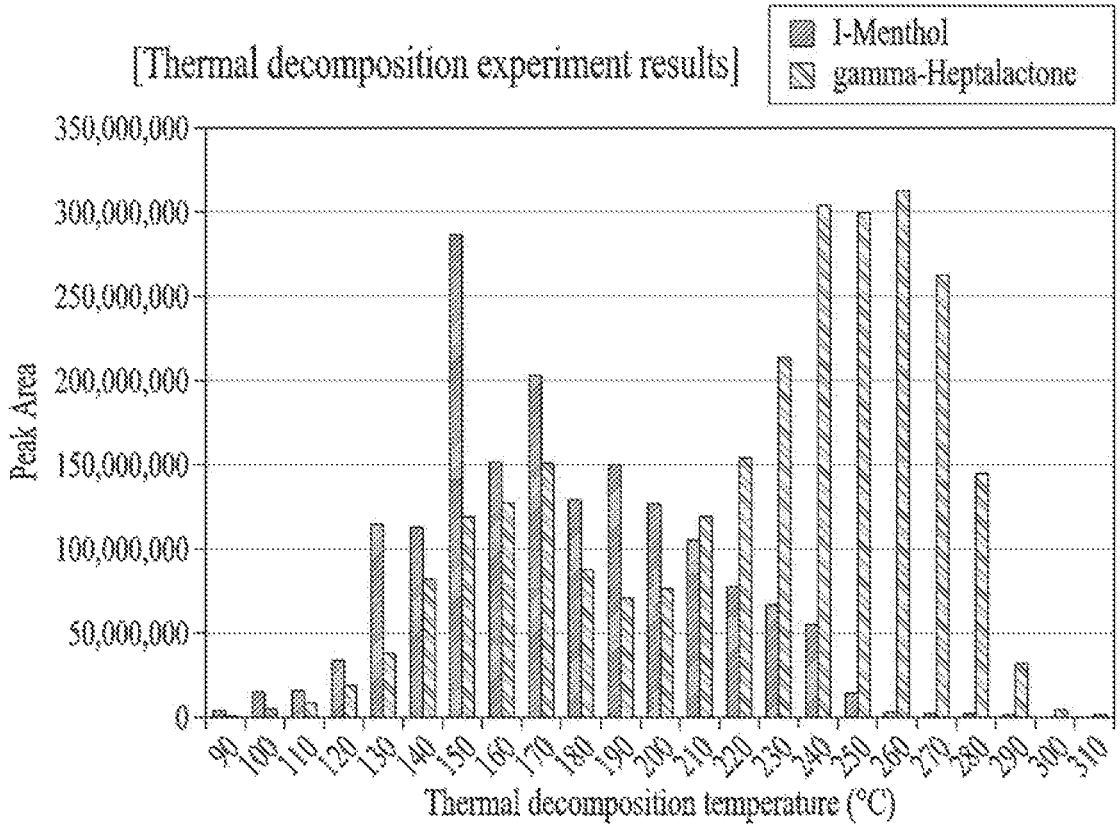
FIG. 17 is a diagram illustrating the distribution of ingredients according to the thermal decomposition temperature of sodium (4-mentylcarbonyloxy) undecanoate (5d) prepared in an example according to one embodiment of the present disclosure.

In FIGS. 15 to 17, it may be confirmed that menthol and gamma-undecalactone are decomposed at a temperature of approximately 120° C. as a result of the thermal decomposition test of Compound [2B].

Figure 18:
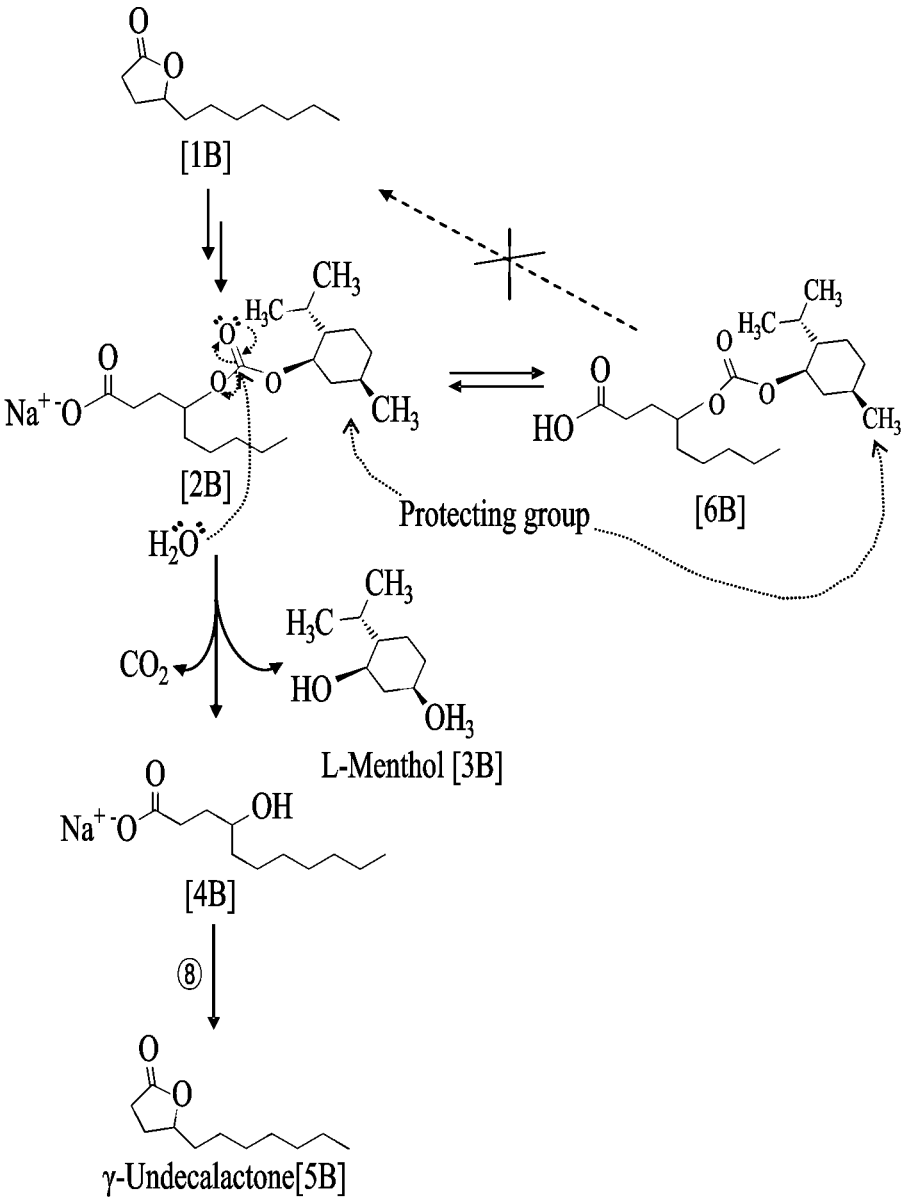
FIG. 18 is a diagram illustrating a pyrolysis mechanism according to one embodiment of the present disclosure.

That is, as shown in FIG. 18, lactone [1B, gamma-undecalactone] was ring-opened, and a hydroxyl group was covalently bonded with L-menthol through a carbonate linking group (carbonate linkage) to prepare Compound [2B]. After Compound [2B] is applied to the product matrix, Compound [4B] with exposed hydroxyl groups is formed as L-menthol ([3B]) and $CO_2$ are being generated by heat. Compound [4B] is also subjected to ring-closing (intramolecular esterification) by heat to produce gamma-undecalactone [5B]. In the [2B] state, the hydroxyl group is protected with a menthyl carbonate group so that the occurrence of ring-closing (intramolecular esterification) may be suppressed at room temperature.

The compound according to the present disclosure expressing the flavor ingredients by being thermally decomposed is as follows. Looking at the thermal decomposition pattern of Compound [2B], menthol is thermally decomposed and expressed while it reaches a temperature from 120° C. to 260° C., and gamma-lactone is first expressed while it reaches a temperature from 120° C. to 200° C., and subsequently, secondary expression also becomes abundant while it reaches a temperature from 200° C. to 300° C. Perhaps, even if menthol, which is used as a protecting group, is deprotected by heat and expressed, it seems to exist for a while as a compound state in the form of [4B], that is, as an intermediate state. Eventually, lactone is produced by intramolecular esterification, but this ring-closing may be retarded in the salt form state. In addition, as a result of the thermal decomposition experiment, as the temperature increased, menthol was thermally decomposed and expressed, and when it is in the [4B] state of the salt form, intramolecular esterification occurred at a little higher temperature to produce lactone [5B]. In other words, it could be found that remaining ring-closing occurs in a high temperature range with a time difference from the temperature range where menthol is thermally decomposed.

Example 2

A wallpaper sheet (about 2 mm thick) was manufactured by mixing 1 wt % of a target product of Preparation Example (synthesized sodium (4-mentylcarbonyloxy) heptanoate) (5a), 90 wt % of a base substrate (natural long fiber, pulp, and carboxymethyl cellulose (CMC), 15:50:5 (w/w)), and the balance of water, coating the mixture on a substrate, and drying it. The sheet was sniffed at room temperature, but there was no smell of the flavoring compounds used in the synthesis of the target product. It was confirmed that flavors (e.g., lactone flavor and menthol flavor used in the synthesis of the target product) were expressed during the combustion of the wallpaper sheet.

Example 3

A wallpaper sheet (approximately 2 mm thick) was manufactured by mixing 0.01 to 5 wt % of a target product of Preparation Example (synthesized sodium 5-(mentylcarbonyloxy) decanoate) (5c), 90 wt % of a base substrate (natural long fiber, pulp, and carboxymethyl cellulose (CMC), 15:50:5 (w/w)), and the balance of water, coating the mixture on a substrate, and drying it. The sheet was sniffed at room temperature, but there was no smell of the flavoring compounds used in the synthesis of the target product. It was confirmed that flavors (e.g., lactone flavor and menthol flavor used in 20 the synthesis of the target product) were expressed during the combustion of the wallpaper sheet.

Example 4

A wallpaper sheet (approximately 2 mm thick) was manufactured by mixing 1 wt % of a target product of Preparation Example (synthesized sodium (4-(mentylcarbonyloxy) undecanoate) (5d), 95 wt % of a base substrate (natural long fiber, pulp, and carboxymethyl cellulose (CMC), 15:50:5 (w/w)), and the balance of water, coating the mixture on a substrate, and drying it. The sheet was sniffed at room temperature, but there was no smell of the flavoring compounds used in the synthesis of the target product. It was confirmed that flavors (e.g., lactone flavor and menthol flavor used in the synthesis of the target product) were expressed during the combustion of the wallpaper sheet.

Example 5

A liquid paint composition including 1 wt % of a target product of Preparation Example (synthesized sodium (4-(mentylcarbonyloxy) heptanoate) (5a), 80 wt % of a base substrate (natural long fiber, pulp, and carboxymethyl cellulose (CMC)=15:50 to 60:5 (w/w)), propylene glycol, *terrapin* oil, and the balance of water was prepared. The liquid composition was painted on a concrete wall with a brush and dried to finish with a wallpaper-like feel. The finished wall was sniffed at room temperature, but there was no smell of the flavoring compounds used in the synthesis of the target product. It was confirmed that, when furniture was burnt near the wall so that the wall is heated, flavors (e.g., lactone flavor and menthol flavor used in the synthesis of the target product) were expressed from the wall.

Although the embodiments have been described with reference to the limited examples and drawings as described above, various modifications and variations are possible from the above description by one of ordinary skill in the art. For example, appropriate results may be achieved although described techniques are performed in order different from a described method, and/or described elements are joined or combined in a form different from the described method, or replaced or substituted by other elements or equivalents. Therefore, other implementations, other embodiments, and equivalents to the scope of claims also belong to the scope of the claims to be described later.

The invention claimed is:

1. A wallpaper composition, comprising:

a compound represented by the following Formula 1; and a base material comprising at least one selected from the group consisting of fiber, pulp, cellulose-based resin, and liquid resin,

[Formula 1]

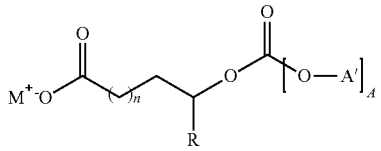

wherein in Formula 1, n is an integer of 1 or 2, M is selected from Mg, Ca, alkali metals and transition metals, R is a straight-chain or branched-chain alkyl group having 1 to 30 carbon atoms, and moiety A is a moiety derived from a flavoring compound having at least one of an aromatic ring, an aliphatic ring, and an aliphatic chain which have a hydroxyl group, wherein the hydroxyl group participates in a carbonate linking group

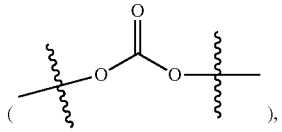

and A' corresponds to a flavoring compound except for the hydroxyl group.

2. The wallpaper composition of claim 1, wherein the flavoring compound is selected from a cyclic monoterpene-based compound having a hydroxyl group, a monoterpene-based acyclic compound having a hydroxyl group, a $C_6$-$C_{10}$ aromatic compound having a hydroxyl group, and a $C_5$-$C_6$ non-aromatic ring having a hydroxyl group.

3. The wallpaper composition of claim 1, wherein the flavoring compound is selected from the following formulas:

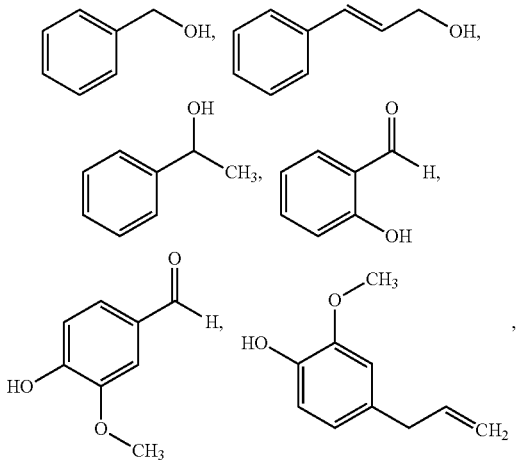

-continued

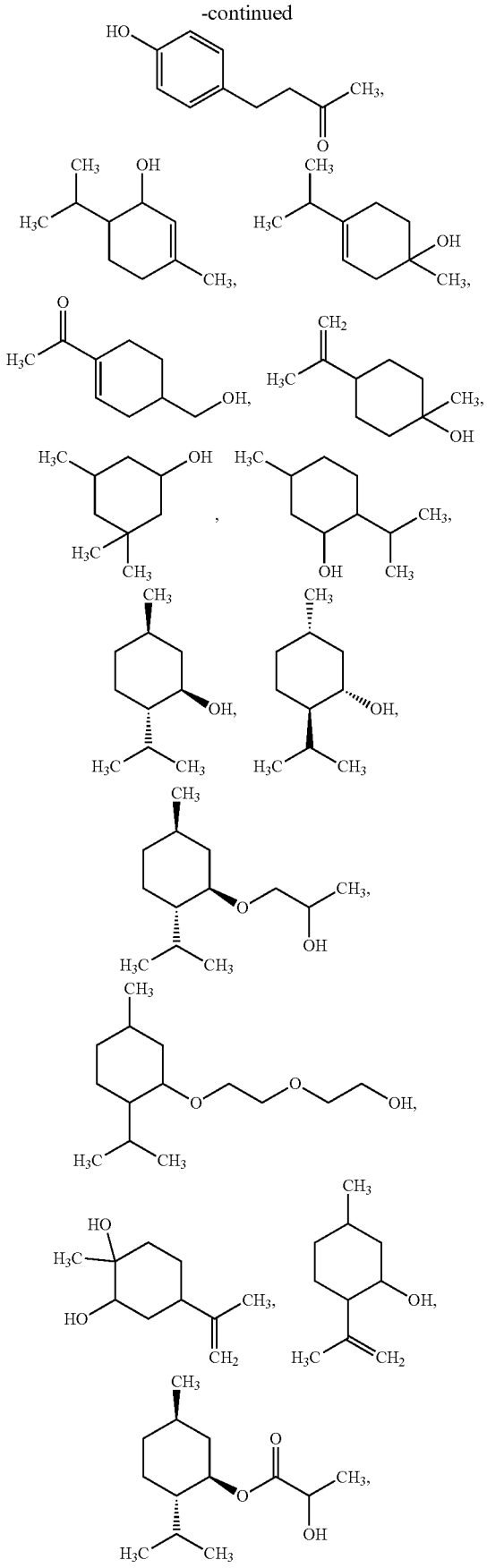

-continued
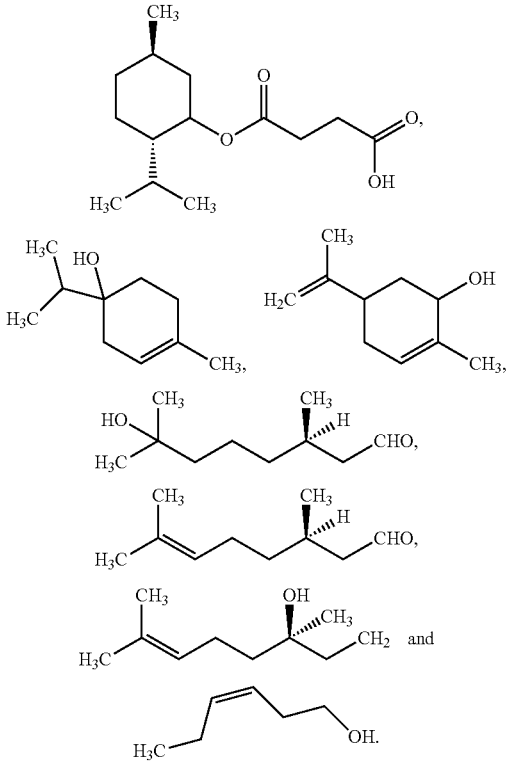
4. The wallpaper composition of claim 1, wherein the A' is selected from the following formulas:
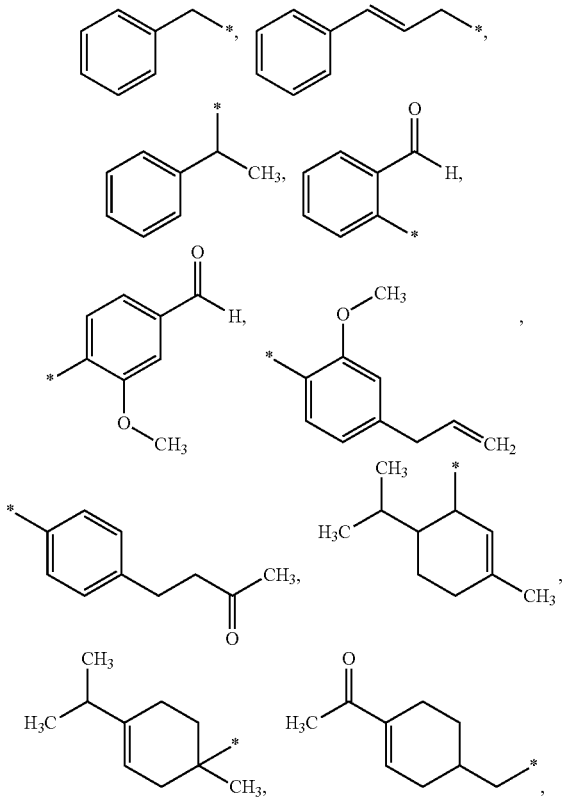
-continued
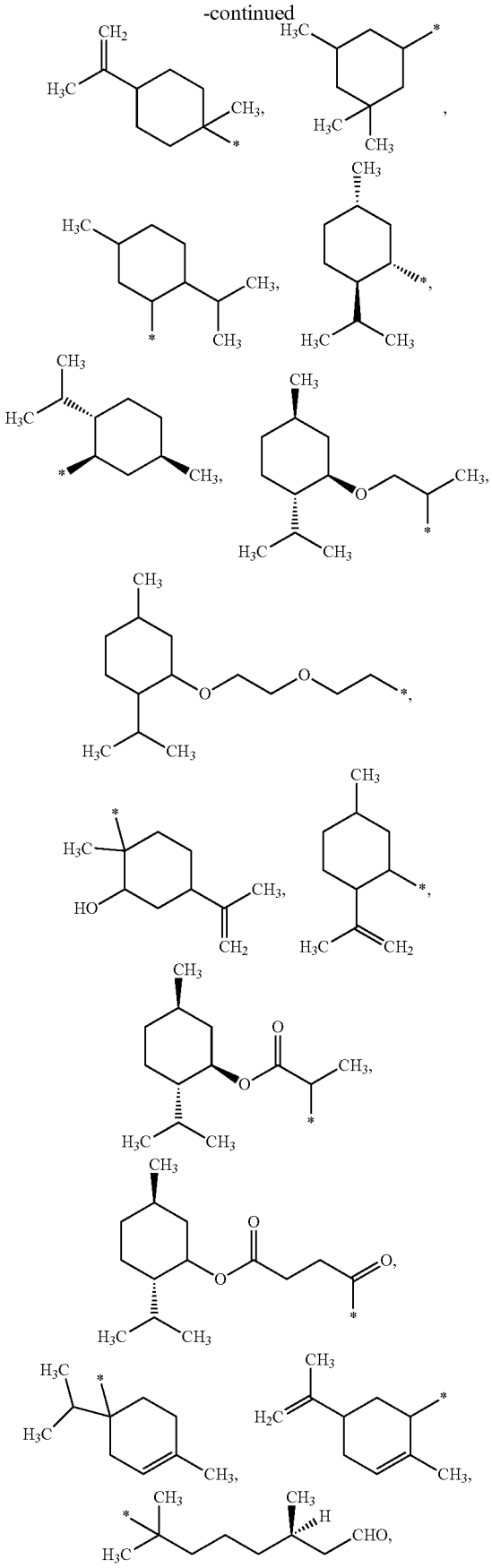

-continued

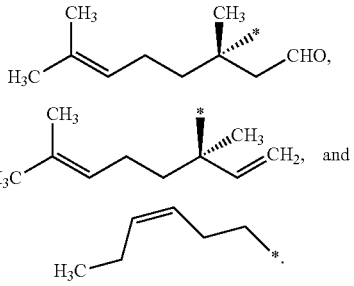

wherein * is the binding site of oxygen in the carbonate.

5. The wallpaper composition of claim 1, wherein the transition metal is selected from Zr, Co, Rh, Ir, Nb, Pd, Pt, Fe, Ru, Os, Cr, Mo, W, Mn, Tc, Re, Cu, Ag, and Au, and the alkali metal is selected from Li, Na, K, Rb, and Cs.

6. The wallpaper composition of claim 1, wherein the compound is selected from the following formulas 1-1 to 1-28:

[Formula 1-1]

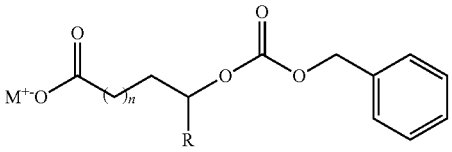

[Formula 1-2]

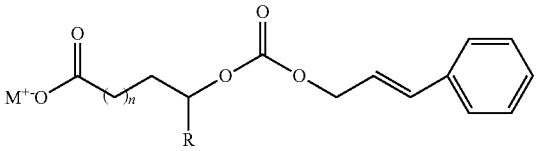

[Formula 1-3]

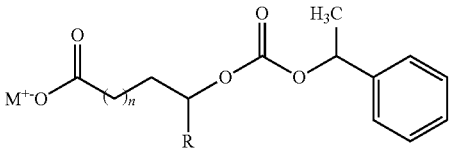

[Formula 1-4]

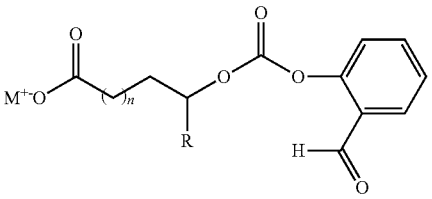

[Formula 1-5]

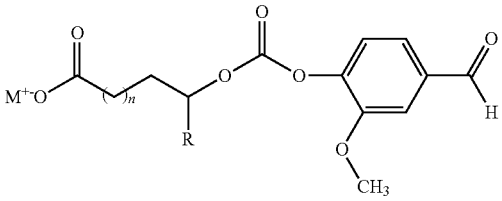

-continued

[Formula 1-6]

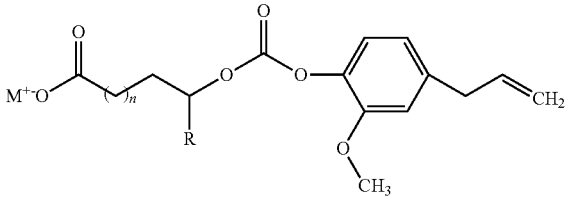

[Formula 1-7]

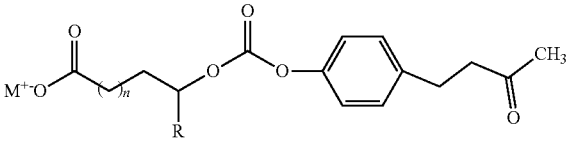

[Formula 1-8]

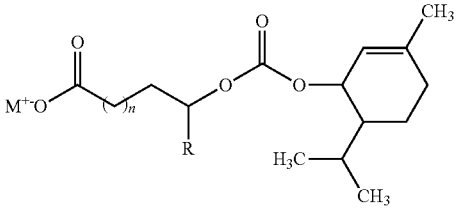

[Formula 1-9]

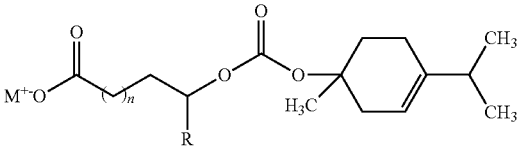

[Formula 1-10]

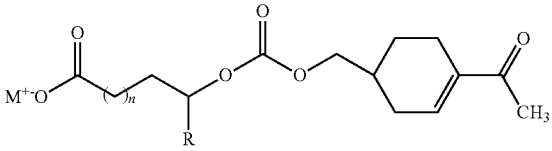

[Formula 1-11]

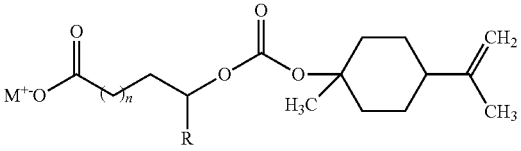

[Formula 1-12]

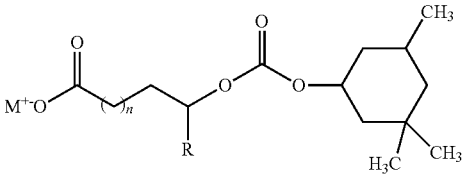

[Formula 1-13]

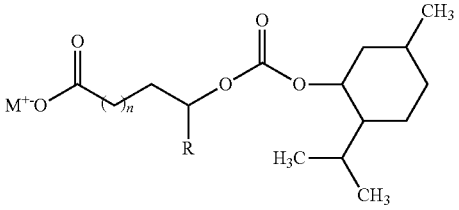

-continued

[Formula 1-14]

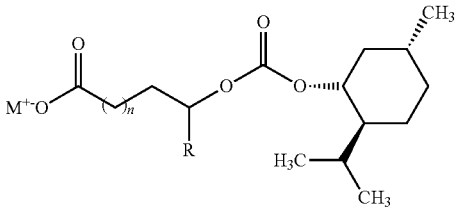

[Formula 1-15]

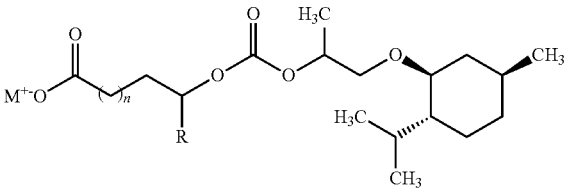

[Formula 1-16]

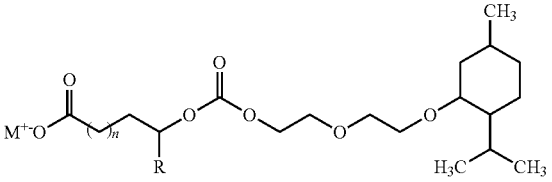

[Formula 1-17]

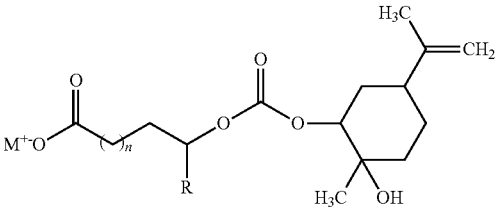

[Formula 1-18]

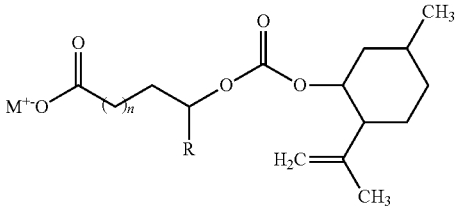

[Formula 1-19]

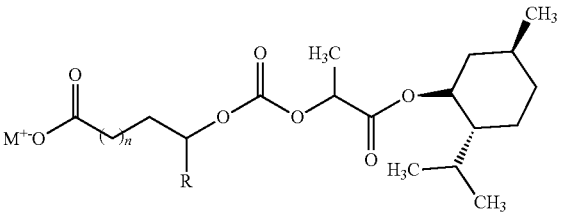

[Formula 1-20]

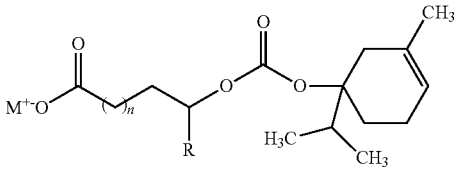

-continued

[Formula 1-21]

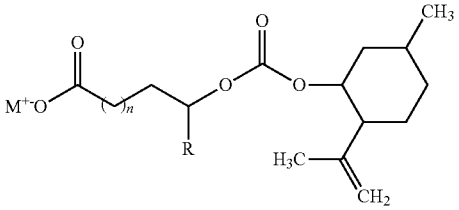

[Formula 1-22]

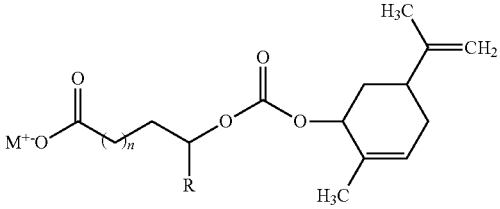

[Formula 1-23]

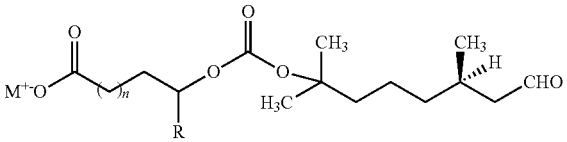

[Formula 1-24]

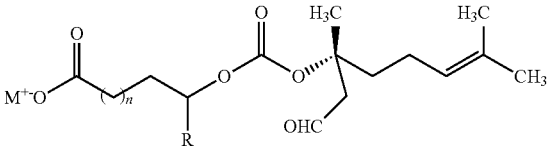

[Formula 1-25]

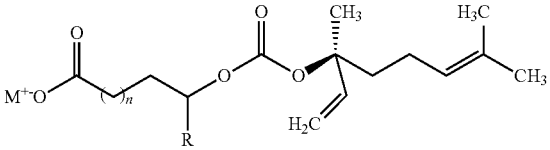

[Formula 1-26]

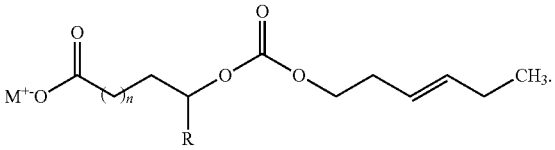

wherein M and R are as defined in Formula 1 above.

7. The wallpaper composition of claim 1, wherein the compound is a flavoring agent compound that expresses flavor upon thermal decomposition.

8. The wallpaper composition of claim 1, wherein the compound is decomposed into the flavoring compound, a lactone compound, and carbon dioxide during thermal decomposition.

9. The wallpaper composition of claim 8, wherein the lactone compound is gamma lactone of the following Formula 2 or delta lactone of the following Formula 3:

[Formula 2]

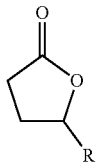

[Formula 3]

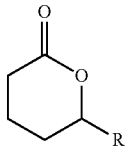

wherein R is a straight-chain or branched-chain alkyl group having 1 to 30 carbon atoms.

10. The wallpaper composition of claim 8, wherein the lactone compound is selected from the following formulas:

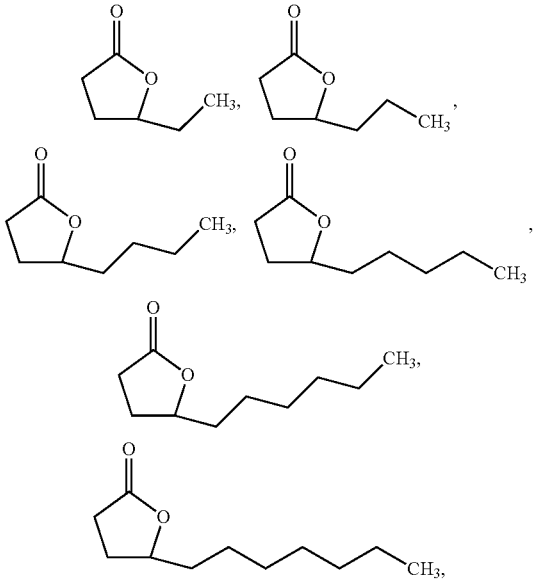

-continued

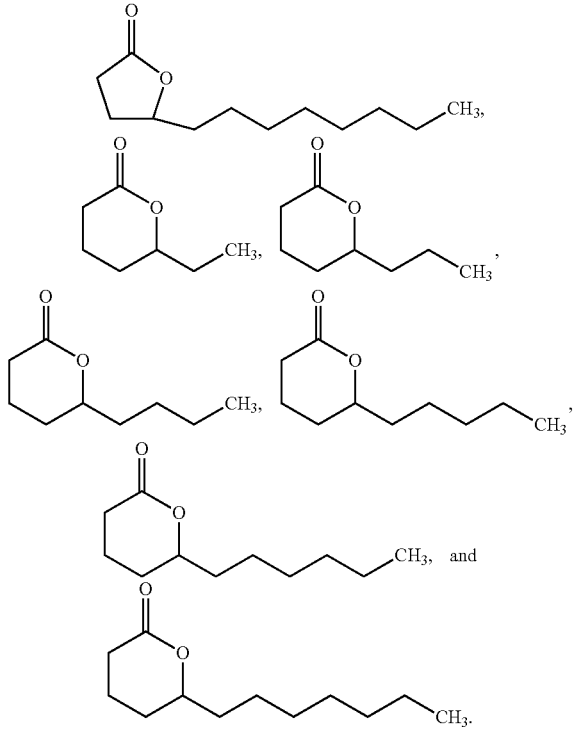

11. The wallpaper composition of claim 1, wherein the compound is thermally decomposed at a temperature of 80° C. or higher.

12. The wallpaper composition of claim 1, wherein the composition comprises water, a water-soluble organic solvent, or both thereof.

13. The wallpaper composition of claim 1, wherein the wallpaper composition is a solid phase, a slurry, a paste, a gel, a liquid phase, an emulsion, or an aerosol.

14. A wallpaper manufactured of the composition of claim 1.

15. The wallpaper of claim 14, wherein the wallpaper is a paint wallpaper or sheet-type wallpaper.

16. The wallpaper of claim 14, wherein the wallpaper releases flavor upon exposure to combustion or ignition temperatures.

* * * * *